US010224009B2

(12) United States Patent
Lyles

(10) Patent No.: US 10,224,009 B2
(45) Date of Patent: Mar. 5, 2019

(54) STRING TENSIONER FOR STRINGED INSTRUMENT

(71) Applicant: Cosmos Lyles, New York, NY (US)

(72) Inventor: Cosmos Lyles, New York, NY (US)

( * ) Notice: Subject to any disclaimer, the term of this patent is extended or adjusted under 35 U.S.C. 154(b) by 0 days.

(21) Appl. No.: 15/785,306

(22) Filed: Oct. 16, 2017

(65) Prior Publication Data

US 2018/0040312 A1 Feb. 8, 2018

Related U.S. Application Data

(63) Continuation of application No. 15/004,886, filed on Jan. 22, 2016, now Pat. No. 9,792,886.

(60) Provisional application No. 62/106,697, filed on Jan. 22, 2015.

(51) Int. Cl.
*G10D 3/12* (2006.01)
*G10D 1/08* (2006.01)

(52) U.S. Cl.
CPC ..... *G10D 3/12* (2013.01); *G10D 1/085* (2013.01)

(58) Field of Classification Search
CPC ..... G10D 3/12; G10D 1/085
See application file for complete search history.

(56) References Cited

U.S. PATENT DOCUMENTS 16,995 A * 4/1857 Randle ..... G10D 3/14 84/297 R
1,416,468 A * 5/1922 Hoffman ..... B60R 19/14 180/280
1,416,568 A 5/1922 Mazzocco
1,626,753 A * 5/1927 Carlson ..... G10D 3/14 84/297 R
1,684,057 A * 9/1928 Fisher ..... G10D 3/14 84/297 R (Continued)

FOREIGN PATENT DOCUMENTS

WO WO 2006-023600 A2 3/2006
WO WO 2007-106600 A2 9/2007

OTHER PUBLICATIONS

International Search Report on related PCT Application No. PCT/US2014/053939 from International Searching Authority (KIPO) dated Dec. 11, 2014.

(Continued)

*Primary Examiner* — Robert W Horn
(74) *Attorney, Agent, or Firm* — Klein, O'Neill & Singh, LLP

(57) ABSTRACT

A string tensioner module for a stringed musical instrument is configured to apply a constant or near-constant tension to the musical strings of the instrument. The module is divided into a plurality of string tensioners, one string tensioner for each musical string. Each string tensioner employs a primary spring that apply the primary force coaxial with the string. Each string tensioner also employs a secondary spring that applies a secondary force in a direction crossing the axis of the string, and thus applying an axial force component that changes as the angle of the secondary spring changes. The primary and secondary springs are selected so that the change in the axial force component of the secondary spring as the string changes in length approximates the change in force applied by the primary spring so that the axial force applied to the string remains generally constant even as the string changes in length.

20 Claims, 19 Drawing Sheets

(56) References Cited

U.S. PATENT DOCUMENTS 2,070,916 A * 2/1937 Peate ..... G10D 3/14 84/297 R
2,130,248 A * 9/1938 Peate ..... G10C 3/103 84/297 R
2,298,611 A * 10/1942 Bruderlin ..... B64C 13/30 244/233
2,453,572 A * 11/1948 Ferrier ..... G10D 3/143 84/207
2,514,835 A * 7/1950 Bredice ..... G10D 3/14 73/862.393
2,605,061 A * 7/1952 Howe ..... B65H 59/16 188/290
3,667,336 A * 6/1972 Itzler ..... G10D 3/14 84/297 R
4,909,126 A * 3/1990 Skinn ..... G10G 7/02 84/454
5,018,700 A * 5/1991 Hardtke ..... F16L 3/2056 248/571
5,040,741 A * 8/1991 Brown ..... B65H 59/06 242/128
5,095,797 A * 3/1992 Zacaroli ..... G10G 7/02 84/455
5,284,396 A * 2/1994 Masumura ..... B41J 33/52 226/195
5,323,680 A * 6/1994 Miller ..... G10D 3/14 84/455
5,377,926 A * 1/1995 Min ..... B65H 23/14 242/334.6
5,390,579 A * 2/1995 Burgon ..... G10D 3/14 84/297 R
5,477,765 A * 12/1995 Dietzman ..... G10D 3/146 84/313
7,479,592 B1 * 1/2009 Slavik ..... G10D 3/146 84/312 R
7,554,023 B2 * 6/2009 Tyler ..... G10D 3/12 84/173
7,855,330 B2 * 12/2010 Lyles ..... G10D 3/04 84/297 R
8,152,126 B2 * 4/2012 Hardtke ..... F16L 3/2056 248/542
8,440,897 B1 * 5/2013 Baxter ..... G10D 3/143 84/313
8,779,258 B2 * 7/2014 Lyles ..... G10D 3/10 84/297 R
8,857,110 B2 * 10/2014 Constantinou ..... E04H 9/02 52/167.2
9,318,081 B2 * 4/2016 Lyles ..... G10D 3/14
9,495,941 B2 * 11/2016 Stanley ..... G10D 3/12
9,792,886 B2 * 10/2017 Lyles ..... G10D 1/085
2013/0220099 A1 8/2013 Lyles et al.
2015/0059550 A1 * 3/2015 Lyles ..... G10D 1/085 84/267
2016/0104465 A1 * 4/2016 Lyles ..... G10D 3/04 84/307
2016/0217772 A1 * 7/2016 Lyles ..... G10D 1/085

OTHER PUBLICATIONS

Written Opinion on related PCT Application No. PCT/US2014/053939 from International Searching Authority (KIPO) dated Dec. 11, 2014.

U.S. Appl. No. 15/004,886, filed Jan. 22, 2016, Cosmos Lyles, US 2016-0217772 A1, Office Action dated May 13, 2016; Jan. 6, 2017, Notice of Allowance dated Jun. 15, 2017.

* cited by examiner

STRING TENSIONER FOR STRINGED INSTRUMENT

CROSS-REFERENCE TO RELATED APPLICATIONS

This application is a continuation of U.S. patent application Ser. No. 15/004,886, filed Jan. 22, 2016, which claims priority to U.S. Provisional Application Ser. No. 62/106,697, which was filed Jan. 22, 2015, the entirety of both are hereby incorporated by reference.

This application relates to some of the subject matter concerning methods and apparatus for holding wires or strings as disclosed in Applicant's U.S. Pat. No. 7,855,440, which issued Dec. 21, 2010, and Applicant's copending U.S. application Ser. No. 14/476,619, which was filed Sep. 3, 2014, and Ser. No. 14/882,407, which was filed Oct. 13, 2015. The entirety of each of these related applications are hereby incorporated by reference.

BACKGROUND

The present disclosure relates to the field of stringed musical instruments, and more particularly to string tensioners for stringed musical instruments.

Various products and applications benefit from holding a wire or string at a near-constant, predictable tension over time and in a variety of environmental conditions. Notably, stringed musical instruments create music by vibrating strings held at tension. If the string is at the correct tension for the given instrument, it will vibrate at a desired frequency corresponding to the desired note. However, musical strings tend to stretch or contract over time and/or due to environmental factors such as temperature, humidity or the like. Such stretching or contracting typically results in the tension in the string changing, and the string thus vibrating at a different frequency than the desired frequency. This can result in the string going out of tune—emitting a note that is aurally different than the desired note. Typical stringed musical instruments tend to go out of tune fairly quickly, and musicians often find themselves spending substantial time tuning their instruments, even in the midst of performances.

The appearance of a musician's instrument is often seen as an expression of the artist, and thus musicians tend to desire that their instrument's componentry be non-obtrusive so as not to dominate the appearance. Also, certain instruments, particularly acoustic instruments, can be sensitive to componentry, particularly metal componentry, placed in certain portions of the instrument. Further, componentry should avoid possibly interfering with a musician during play.

SUMMARY

There is a need in the art for a method and apparatus for mounting a string of a stringed musical instrument in a manner so that the string remains at a near-constant tension even if the string stretches or contracts over time and/or due to environmental factors. There is also a need in the art for such a method and apparatus that has a relatively small footprint and can be installed in certain stringed instruments without substantially altering the sound of the instrument, altering its appearance, or interfering with playability. There is a further need for such a structure having simple and adjustable structure.

In accordance with one embodiment, the present specification provides a string holder for stringed musical instrument, comprising a plurality of primary springs, each primary string attached to a longitudinally movable string connector so as to apply a primary spring force directed along an axis to the string connector. The primary spring force applied to the string connector changes in accordance with a primary spring rate function as the string connector moves relative to the primary spring along the axis. A musical string is attached to each string connector and extends along the corresponding axis so that a net axial force applied to the string connector is applied to the musical string. A secondary spring is structure attached to the string connector of each of the plurality of primary springs so as to apply a plurality of secondary spring forces, one of the plurality of secondary spring forces being applied to each of the string connectors. Each of the secondary spring forces is directed across the axis of the corresponding string connector and has an axial component that is applied to the corresponding string connector in a direction along the corresponding axis. The secondary spring force is configured so that the axial component of the secondary spring force varies in accordance with a secondary spring rate function as the string connector moves relative to the primary spring along the axis.

In additional embodiments, the secondary spring structure comprises an undulating sheet of spring metal.

In further embodiments, the secondary spring force is configured so that the axial component of the secondary spring force varies in accordance with a secondary spring rate function as the string connector moves relative to the primary spring along the axis.

In some embodiments, each primary spring is attached to a spring holder that is configured to selectively change the spring rate of the primary spring. In some such embodiments, the primary spring rate function is substantially the same as the secondary spring rate function.

In some embodiments, the net axial force applied to the each string connector comprises the sum of the corresponding primary spring force and the axial component of the corresponding secondary spring force.

In accordance with another embodiment, the present specification provides a constant tension device, comprising a carrier configured to be movable along an axis; a wire or string attached to the carrier and extending along the axis so that an axial force applied to the carrier is communicated to the wire or string; a target tension defined as a desired tension for the wire or string; and a spring having a first end attached to the carrier and a second end attached to a spring holder so that the spring applies a spring force to the carrier along an axis of the wire or string. The spring holder engages a spring along a portion of its length at and adjacent the second end of the spring, and the portion of the spring engaged by the spring holder is constrained from expanding by the spring holder. The spring holder is configured to selectively engage a greater or lesser portion of the length of the spring so as to vary the spring rate of the spring.

BRIEF DESCRIPTION OF THE DRAWINGS

FIG. 21 is a side view of a portion of a string connector taken along lines 21-21 of FIG. 20;

DESCRIPTION

The following description presents embodiments illustrating inventive aspects that are employed in a plurality of embodiments. It is to be understood that embodiments may exist that are not explicitly discussed herein, but which may employ one or more of the principles described herein. Also, these principles are primarily discussed in the context of stringed musical instruments. However, it is to be understood that the principles described herein can have other applications such as sporting goods, industrial and/or architectural applications in which it may be desired to apply a near-constant force to an item that may move over an operational range and/or employ spring arrangements that can exhibit positive spring rates.

This disclosure describes embodiments of a device that can apply a near-constant tension to a string, wire or the like even as that string, wire or the like changes in length over a range of distance. Notably, Applicant's U.S. Pat. No. 7,855,440, which is incorporated herein by reference in its entirety, teaches similar but distinct principles for achieving a near-constant tension in a wire or string as the wire or string expands and/or contracts.

Figures 1A, 1B:
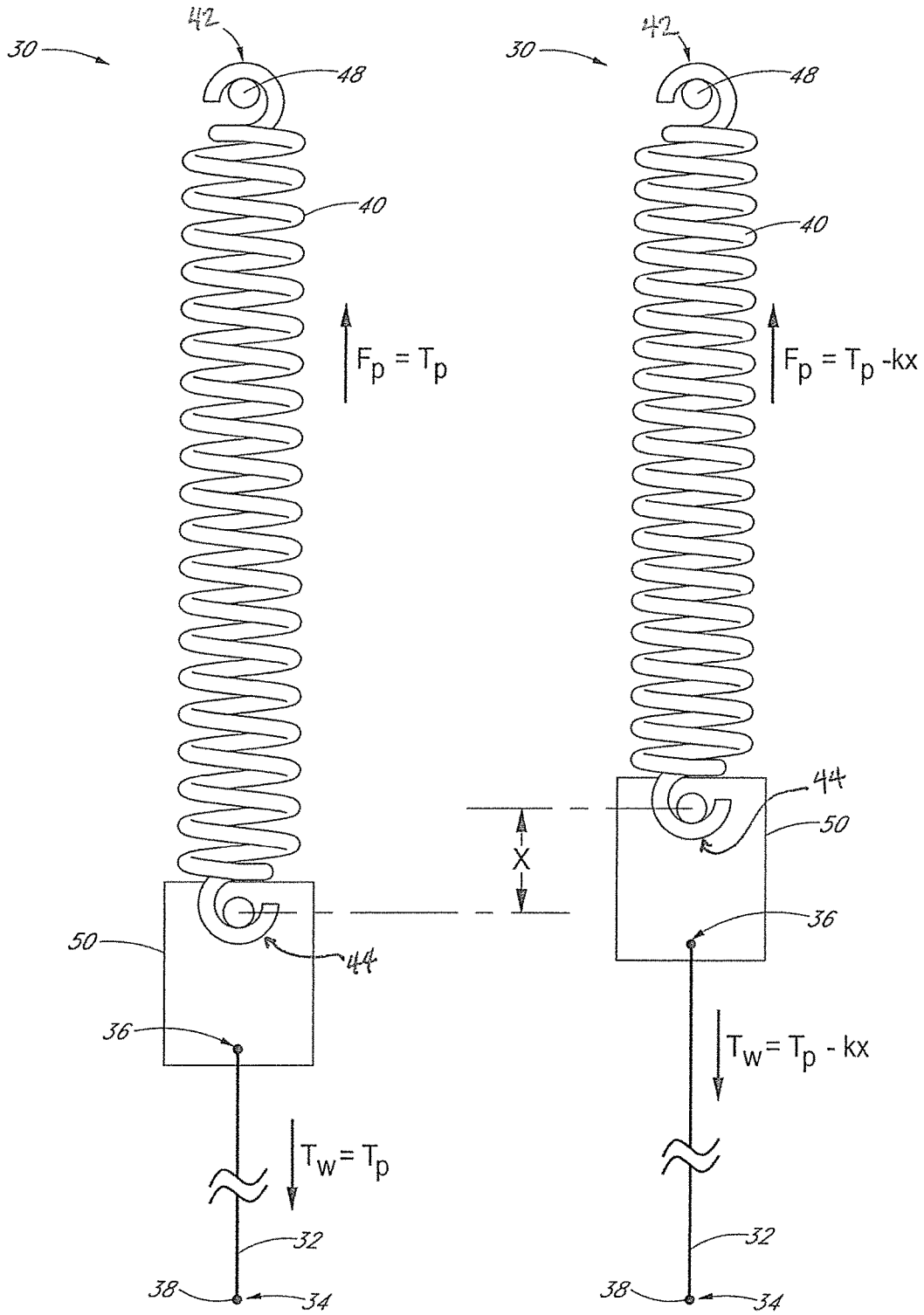
FIG. 1A shows a schematic representation of a spring arrangement.
FIG. 1B shows the spring arrangement of FIG. 1A in a configuration in which a string has stretched.

With initial reference to FIG. 1A, a spring-based tension device 28 comprises a wire or string 30 that has a fixed end 34 and a movable end 36, and a primary spring 40 has a fixed end 42 and a movable end 44. The fixed end 34 of the wire 30 is mounted on a fixed wire mount 38; the fixed end 42 of the primary spring 40 is mounted on a fixed spring mount 48. The primary spring 40 has a spring constant k. The movable ends of the wire 30 and primary spring 40 are both attached at a carrier 50 (or attachment point) so that the primary spring 40 and wire 30 are coaxial. The primary spring 40 pulls on the wire 30 so that the force Fp in the primary spring 40 is identical to the tension Tw in the wire. In this embodiment, a preferred tension is Tp. In FIG. 1A, $Fp=Tw=Tp$.

Over time, the wire 30 may stretch or contract. FIG. 1B illustrates such a situation, as the wire 30 has stretched an axial distance x. Since the spring 40 follows Hooke's law, the force in the spring 40 is reduced by $-kx$, causing a corresponding change to the tension in the wire Tw. Thus, $Fp=Tw=Tp-kx$. As such, the tension in the wire 30 is no longer at the preferred tension Tp. Notably, Hooke's law ($F=-kx$) is a linear function.

Figure 2B:
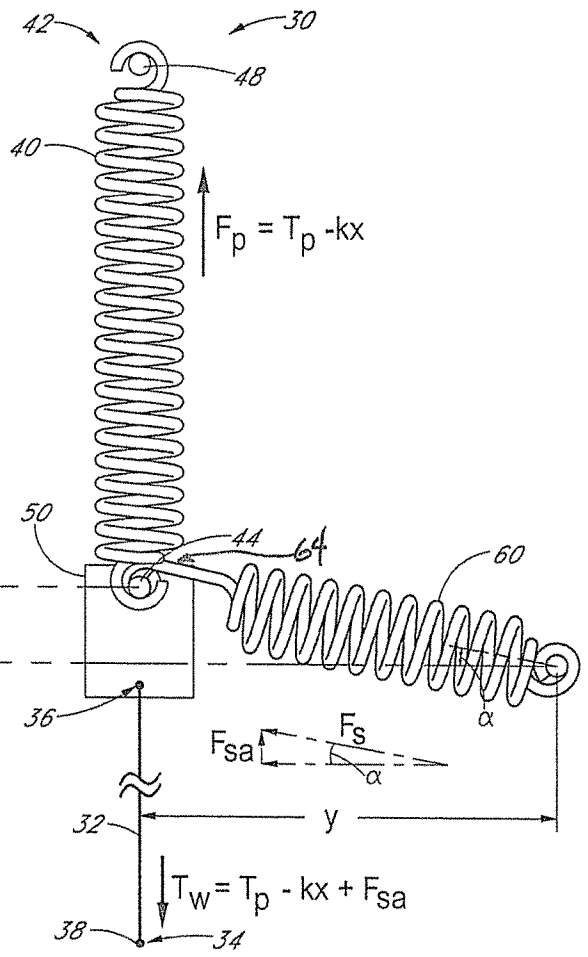
FIG. 2B shows the spring arrangement of FIG. 2A in a configuration in which a string has stretched.
Figure 2A:
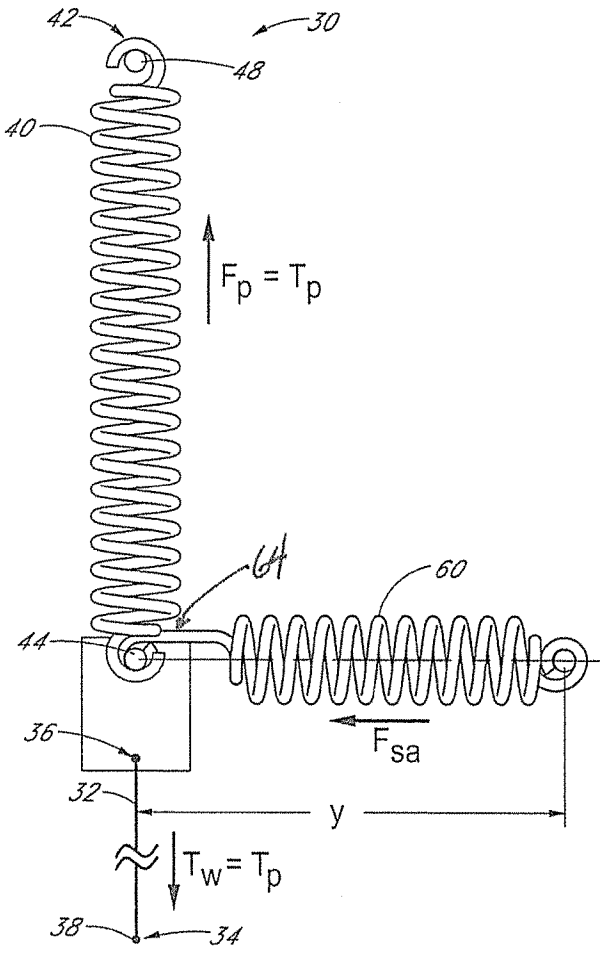
FIG. 2A shows a schematic representation of a spring arrangement in accordance with one embodiment.

FIGS. 2A-B illustrate another embodiment of a spring-based tension device 28 for maintaining the tension in the wire 30 at or near the preferred tension Tp. A secondary spring 60 has a fixed end 62 and a movable end 64. The fixed end 62 is attached to a secondary spring mount 68. The movable end 64 of the secondary spring 60 is attached to the movable ends 36, 44 of the primary spring 40 and wire 30 at the carrier 50. As shown in FIG. 2A, the secondary spring 60 exerts a force Fs which, in the initial position shown in FIG. 2A, is directed normal to the force Fp as applied by the primary spring 60 to the wire 30. Preferably the carrier 50 is constrained so as to move only along a path that is coaxial with the primary spring 40 and the wire 30. Since Fs is directed normal to the attachment point in FIG. 2A, Fs has a vector force component Fsa of zero (0) along the axis. As such, secondary spring force Fs does not affect Tw.

With reference next to FIG. 2B, as discussed above in connection with FIG. 1B, over time the wire 30 may stretch, resulting in a reduction (by kx) of the primary force Fp applied by the primary spring 40 to the wire 30. However, since the carrier 50 moves along the axis a distance x, the secondary spring 60 is rotated an angle $\alpha$ about its fixed end 62. The secondary force Fs is no longer directed normal to the axis, but has an axial vector component (Fsa) determined by the equation $Fs(\sin \alpha)$. As such, the tension in the wire is calculated as $Tw=Tp-kx+Fs(\sin \alpha)$. Note that Fsa can also be determined by $Fs(\cos \theta)$, thus $Tw=Tp-kx+Fs(\cos \theta)$.

At relatively low angles of $\alpha$, such as from about 0-20°, more preferably 0-15°, still more preferably 0-10° and most preferably 0-5°, sin α is a substantially linear function. As noted above, −kx is a totally linear function, in which the primary spring rate k is a constant, and the function is negative. Thus, over such relatively low angles of α, a secondary spring force Fs can be chosen so that over an operating range of deflection (x), the value of a function k(s)x is approximated by Fs(sin α), and a secondary axial spring rate k(s) changes with α and the spring rate function is positive. As such, over the operating range shown in FIG. 2B, as the wire 30 elongates, the force Fp applied by the primary spring 40 decreases, but the axial force component Fsa of the force Fs applied by the secondary spring correspondingly increases, and is directed in the same axial direction as the primary force. As a result, the total tension on the wire Tw remains at or near the preferred tension Tp. Notably, the secondary axial spring rate k(s) at these ranges of α is positive, opposing the negative primary spring rate. Thus, if the wire of FIG. 2B were to contract in length such that α became negative, the tension force applied by the primary spring Fp would increase, but the compressive axial force component Fsa of the force Fs applied by the secondary spring would be directed opposite Fp and have a similar value. As a result, the total tension on the wire Tw would remain at or near the preferred tension Tp.

Table 1 below presents a spreadsheet that demonstrates a real-life scenario of performance of one embodiment having structure as depicted in FIGS. 2A-2B. In the scenario depicted in Table 1, primary spring 40 (Spring 1), secondary spring 60 (Spring 2) and string 30 are attached as represented in FIGS. 2A-B. The primary spring (Spring 1) has a spring rate (k1) of 64 pounds per inch. The secondary spring (Spring 2) is in compression and has a spring rate (k2) of 10 lb./in. The range of travel of the attachment point (carrier 50) is 0.0625 in. In this embodiment the secondary spring (Spring 2) has an initial length y of 0.3 in. and is compressed to have an initial tension (Fs) of 19.7 lb. In this scenario, the initial position of the secondary spring 60 is normal to the primary spring 40.

TABLE 1

| Spring 1 Length | Fp | Spring 2 Length | Fs | Theta (rad) | Fsa | Tw | % Tw change | Theta (deg) | alpha (deg) |
|---|---|---|---|---|---|---|---|---|---|
| 1.4000 | 10.0000 | 0.3000 | 19.7000 | 1.5708 | 0.0000 | 10.0000 | 0.0000 | 90.0000 | 0.0000 |
| 1.3938 | 9.6000 | 0.3001 | 19.6993 | 1.5916 | 0.4103 | 10.0103 | 0.1031 | 91.1935 | 1.1935 |
| 1.3875 | 9.2000 | 0.3003 | 19.6974 | 1.6124 | 0.8200 | 10.0200 | 0.2001 | 92.3859 | 2.3859 |
| 1.3813 | 8.8000 | 0.3006 | 19.6941 | 1.6332 | 1.2285 | 10.0285 | 0.2849 | 93.5763 | 3.5763 |
| 1.3750 | 8.4000 | 0.3010 | 19.6896 | 1.6539 | 1.6351 | 10.0351 | 0.3513 | 94.7636 | 4.7636 |
| 1.3688 | 8.0000 | 0.3016 | 19.6838 | 1.6746 | 2.0394 | 10.0394 | 0.3936 | 95.9469 | 5.9469 |
| 1.3625 | 7.6000 | 0.3023 | 19.6767 | 1.6952 | 2.4406 | 10.0406 | 0.4059 | 97.1250 | 7.1250 |
| 1.3563 | 7.2000 | 0.3032 | 19.6683 | 1.7156 | 2.8383 | 10.0383 | 0.3827 | 98.2971 | 8.2971 |
| 1.3500 | 6.8000 | 0.3041 | 19.6586 | 1.7359 | 3.2319 | 10.0319 | 0.3186 | 99.4623 | 9.4623 |
| 1.3438 | 6.4000 | 0.3052 | 19.6477 | 1.7561 | 3.6208 | 10.0208 | 0.2085 | 100.6197 | 10.6197 |
| 1.3375 | 6.0000 | 0.3064 | 19.6356 | 1.7762 | 4.0048 | 10.0048 | 0.0476 | 101.7683 | 11.7683 |

In the scenario depicted in Table 1, the tension Fp initially in primary spring (Spring 1)—and thus the preferred tension Tp in the wire—is 10 lb., and the initial length L1 of the primary spring 40 is 1.4 in. The spreadsheet simulates an application such as a guitar in which the springs apply the tension to a guitar string, and over time the guitar string stretches (here over a range of travel of 0.0625 in.). The spreadsheet shows the state of the springs and tension in the wire/guitar string at various points along the 0.0625 range of travel.

As shown in FIGS. 2A-2B and as represented in Table 1, as the string 30 stretches, the carrier 50 and associated attachment point moves. As a result, the primary spring 40 (Spring 1) decreases in length a distance x and the primary force Fp correspondingly decreases. However, secondary spring 60 (Spring 2) rotates, thus increasing the axially-directed component force Fsa, which is computed as F scos θ or Fs sin α. Notably, the length L2 of spring 2 will change slightly with the rotation (computed as ((y^2+x^2)^1/2), and thus Fs will change slightly due to the Spring 2 spring rate.

In the scenario depicted in Table 1, over a string stretch of 0.0625 in., secondary spring 60 (Spring 2) rotates almost 12 degrees, and the total tension in the wire (Tw) varies from the preferred (initial) tension Tp by at most about 0.4%. Such a variance would result in minimal, if any, audible changes in guitar string tune.

It is to be understood that various lengths, spring rates, etc. can be selected for the primary and secondary springs in order to vary specific results, but the principle remains that the secondary spring is chosen to approximate the linear change in tension applied by the primary spring as the primary spring moves linearly and the secondary spring (or at least the line of action of the secondary spring) changes such that the rate of change of the axially-directed component force approximately negates the rate of change of the primary spring force.

Figure 3:
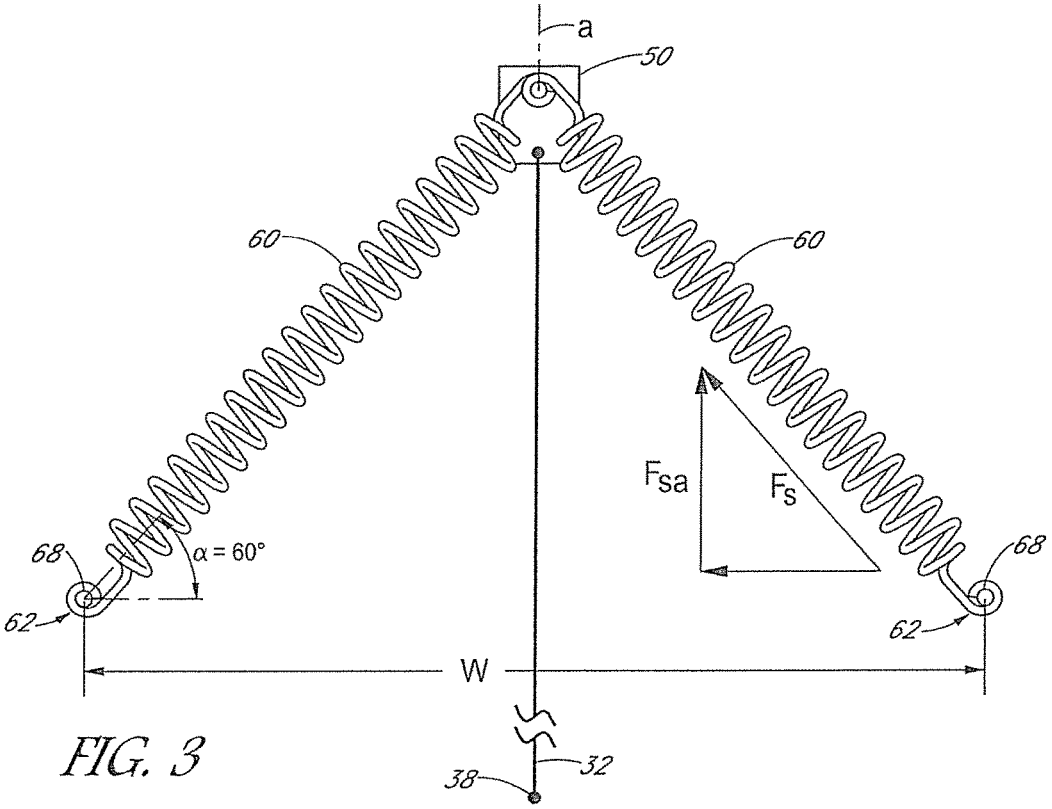
FIGS. 3-5 show a schematic representation of a spring arrangement in accordance with another embodiment, shown at three positions.

With reference next to FIG. 3, in another embodiment, opposing spring mounts 68 are fixed relative one another and are spaced a width w from one another. A pair of identical springs 60 are provided, with a fixed end 62 of each spring attached to a respective one of the fixed spring mounts 68 and a movable end 44 attached to a carrier 50 that is configured to translate linearly along an axis a. As shown, the springs 60 preferably are arranged symmetrically about the axis. A wire 30 or the like can be attached to the carrier 50.

In the embodiment illustrated in FIG. 3, each spring 60 has an angle α relative to a line normal to the axis a. In FIG. 3, α=60°. With additional reference to FIGS. 4 and 5, and also reference to Table 2 below, as the carrier 50 moves along the axis, the angle α decreases, as does the length of the springs 60 and axial force component Fsa of each spring, as the springs are placed into compression. Still further, as demonstrated in Table 2, the effective spring rate of each spring XP along the axis also changes with α.

In Table 2 below, an example is presented in which the springs 60 are initially arranged so that α=60°, and the at-rest length of the springs is 2.0 in. The example spring has a spring rate k of 90 lb./in. and the width w between the fixed spring mounts 68 is 2.0 in., so that each fixed spring mount is 1.0 in. from the axis. Table 2 shows how various aspects of this arrangement change as the carrier 50 moves linearly along the axis as demonstrated in FIGS. 3-5. Specifically, as a decreases, the length L of each spring decreases, and each spring is placed into compression, exerting spring force Fs. The spring force can be broken into components, including the axial component of force Fsa. With each decrease of one degree of a there is a corresponding incremental change in axial distance moved by the carrier 50. The axial force Fsa divided by the incremental axial distance indicates an axial spring rate ka at that point along the movement of the springs. Thus, as shown in Table 2, the axial spring rate changes with α.

TABLE 2

| Alpha (deg) | Length L | Spring Force F | Axial Force Fa | Axial distance | Axial Spring Rate ka |
|---|---|---|---|---|---|
| 60 | 2.0000 | 0.0000 | 0.0000 | | |
| 59 | 1.9416 | 5.2556 | 4.5050 | 0.0678 | −66.4730 |
| 58 | 1.8871 | 10.1628 | 8.6185 | 0.0639 | −64.3302 |
| 57 | 1.8361 | 14.7529 | 12.3729 | 0.0605 | −62.0859 |
| 56 | 1.7883 | 19.0538 | 15.7963 | 0.0573 | −59.7414 |
| 55 | 1.7434 | 23.0898 | 18.9140 | 0.0544 | −57.2983 |
| 54 | 1.7013 | 26.8829 | 21.7487 | 0.0518 | −54.7586 |
| 53 | 1.6616 | 30.4524 | 24.3204 | 0.0493 | −52.1245 |
| 52 | 1.6243 | 33.8158 | 26.6472 | 0.0471 | −49.3986 |
| 51 | 1.5890 | 36.9886 | 28.7455 | 0.0450 | −46.5837 |
| 50 | 1.5557 | 39.9849 | 30.6302 | 0.0431 | −43.6832 |
| 49 | 1.5243 | 42.8172 | 32.3146 | 0.0414 | −40.7003 |
| 48 | 1.4945 | 45.4971 | 33.8109 | 0.0398 | −37.6391 |
| 47 | 1.4663 | 48.0349 | 35.1305 | 0.0382 | −34.5034 |
| 46 | 1.4396 | 50.4399 | 36.2834 | 0.0368 | −31.2976 |
| 45 | 1.4142 | 52.7208 | 37.2792 | 0.0355 | −28.0263 |
| 44 | 1.3902 | 54.8853 | 38.1265 | 0.0343 | −24.6944 |
| 43 | 1.3673 | 56.9405 | 38.8333 | 0.0332 | −21.3069 |
| 42 | 1.3456 | 58.8931 | 39.4071 | 0.0321 | −17.8692 |
| 41 | 1.3250 | 60.7488 | 39.8548 | 0.0311 | −14.3866 |
| 40 | 1.3054 | 62.5133 | 40.1828 | 0.0302 | −10.8650 |
| 39 | 1.2868 | 64.1916 | 40.3971 | 0.0293 | −7.3103 |
| 38 | 1.2690 | 65.7884 | 40.5034 | 0.0285 | −3.7283 |
| 37 | 1.2521 | 67.3078 | 40.5068 | 0.0277 | −0.1255 |
| 36 | 1.2361 | 68.7539 | 40.4125 | 0.0270 | 3.4919 |
| 35 | 1.2208 | 70.1303 | 40.2251 | 0.0263 | 7.1174 |
| 34 | 1.2062 | 71.4404 | 39.9490 | 0.0257 | 10.7445 |
| 33 | 1.1924 | 72.6873 | 39.5883 | 0.0251 | 14.3665 |
| 32 | 1.1792 | 73.8739 | 39.1472 | 0.0245 | 17.9767 |
| 31 | 1.1666 | 75.0030 | 38.6294 | 0.0240 | 21.5683 |
| 30 | 1.1547 | 76.0770 | 38.0385 | 0.0235 | 25.1345 |
| 29 | 1.1434 | 77.0981 | 37.3779 | 0.0230 | 28.6686 |
| 28 | 1.1326 | 78.0687 | 36.6510 | 0.0226 | 32.1636 |
| 27 | 1.1223 | 78.9906 | 35.8610 | 0.0222 | 35.6128 |
| 26 | 1.1126 | 79.8658 | 35.0109 | 0.0218 | 39.0094 |
| 25 | 1.1034 | 80.6960 | 34.1036 | 0.0214 | 42.3467 |
| 24 | 1.0946 | 81.4827 | 33.1420 | 0.0211 | 45.6182 |
| 23 | 1.0864 | 82.2276 | 32.1289 | 0.0208 | 48.8171 |
| 22 | 1.0785 | 82.9319 | 31.0668 | 0.0204 | 51.9372 |
| 21 | 1.0711 | 83.5970 | 29.9585 | 0.0202 | 54.9721 |
| 20 | 1.0642 | 84.2240 | 28.8063 | 0.0199 | 57.9157 |
| 19 | 1.0576 | 84.8141 | 27.6128 | 0.0196 | 60.7619 |
| 18 | 1.0515 | 85.3684 | 26.3803 | 0.0194 | 63.5048 |
| 17 | 1.0457 | 85.8877 | 25.1111 | 0.0192 | 66.1389 |
| 16 | 1.0403 | 86.3731 | 23.8076 | 0.0190 | 68.6587 |
| 15 | 1.0353 | 86.8251 | 22.4720 | 0.0188 | 71.0590 |
| 14 | 1.0306 | 87.2448 | 21.1064 | 0.0186 | 73.3347 |
| 13 | 1.0263 | 87.6326 | 19.7131 | 0.0185 | 75.4812 |
| 12 | 1.0223 | 87.9893 | 18.2940 | 0.0183 | 77.4939 |
| 11 | 1.0187 | 88.3155 | 16.8514 | 0.0182 | 79.3685 |
| 10 | 1.0154 | 88.6116 | 15.3872 | 0.0181 | 81.1013 |
| 9 | 1.0125 | 88.8781 | 13.9036 | 0.0179 | 82.6884 |
| 8 | 1.0098 | 89.1155 | 12.4025 | 0.0178 | 84.1266 |
| 7 | 1.0075 | 89.3241 | 10.8859 | 0.0178 | 85.4127 |
| 6 | 1.0055 | 89.5043 | 9.3557 | 0.0177 | 86.5442 |
| 5 | 1.0038 | 89.6562 | 7.8141 | 0.0176 | 87.5185 |
| 4 | 1.0024 | 89.7802 | 6.2628 | 0.0176 | 88.3336 |
| 3 | 1.0014 | 89.8765 | 4.7038 | 0.0175 | 88.9878 |
| 2 | 1.0006 | 89.9451 | 3.1390 | 0.0175 | 89.4797 |
| 1 | 1.0002 | 89.9863 | 1.5705 | 0.0175 | 89.8082 |
| 0 | 1.0000 | 90.0000 | 0.0000 | 0.0175 | 89.9726 |
| −1 | 1.0002 | 89.9863 | −1.5705 | 0.0175 | 89.9726 |
| −2 | 1.0006 | 89.9451 | −3.1390 | 0.0175 | 89.8082 |
| −3 | 1.0014 | 89.8765 | −4.7038 | 0.0175 | 89.4797 |

TABLE 2-continued

| Alpha (deg) | Length L | Spring Force F | Axial Force Fa | Axial distance | Axial Spring Rate ka |
|---|---|---|---|---|---|
| −4 | 1.0024 | 89.7802 | −6.2628 | 0.0175 | 88.9878 |
| −5 | 1.0038 | 89.6562 | −7.8141 | 0.0176 | 88.3336 |

Figure 4:
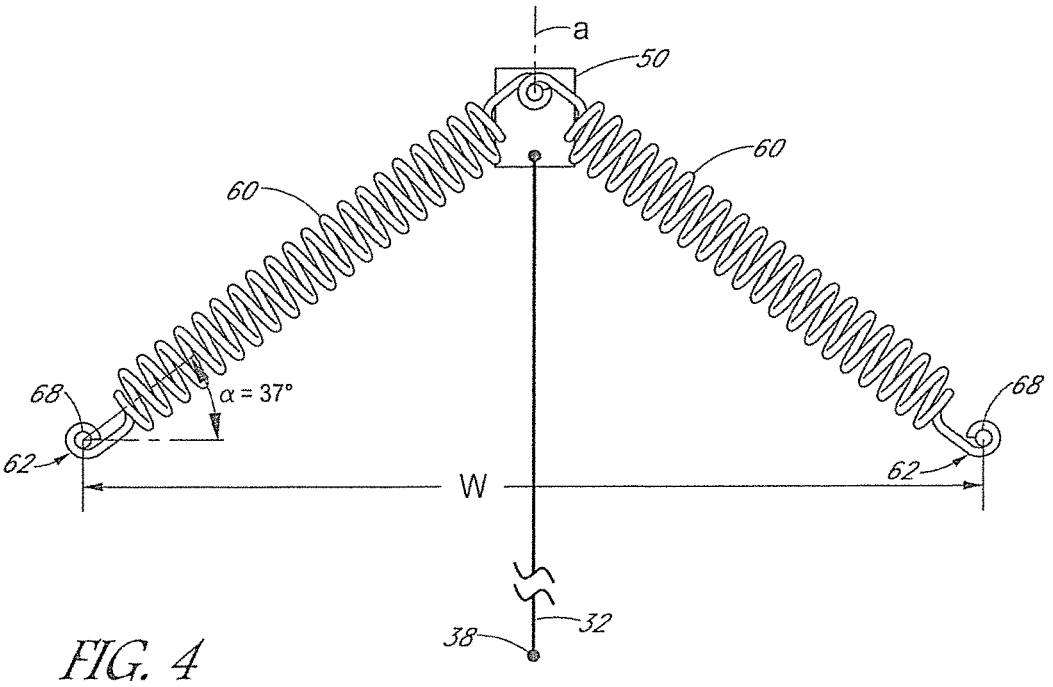
Figure 5:
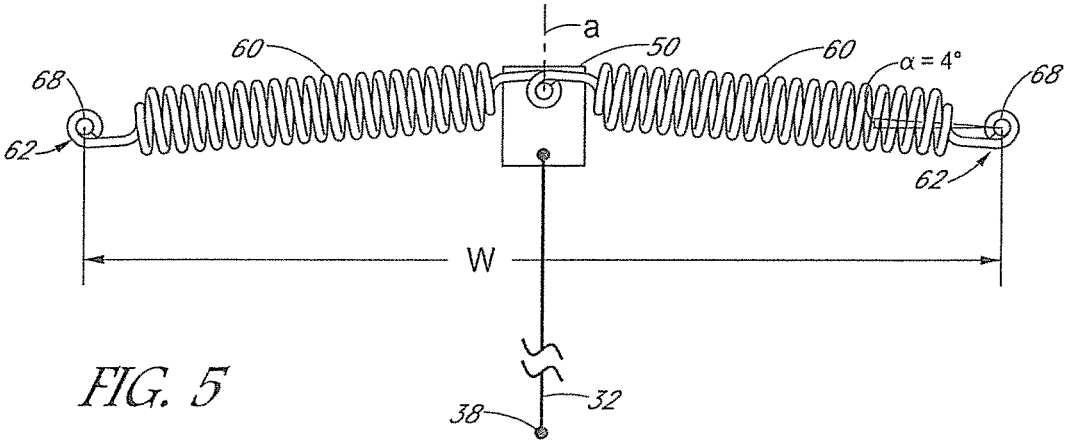

With specific reference next to FIG. 4 and Table 2, when α is about 37°, the incremental axial spring rate transitions from a negative spring rate to a positive spring rate. Also, with reference to FIG. 5 and Table 2, the incremental spring rate that angles near α=0° is nearly constant and, in the illustrated embodiment, positive. More specifically, in the zone around α=0° from about α=5° to α=−5°, the spring rate is generally constant.

Figure 6:
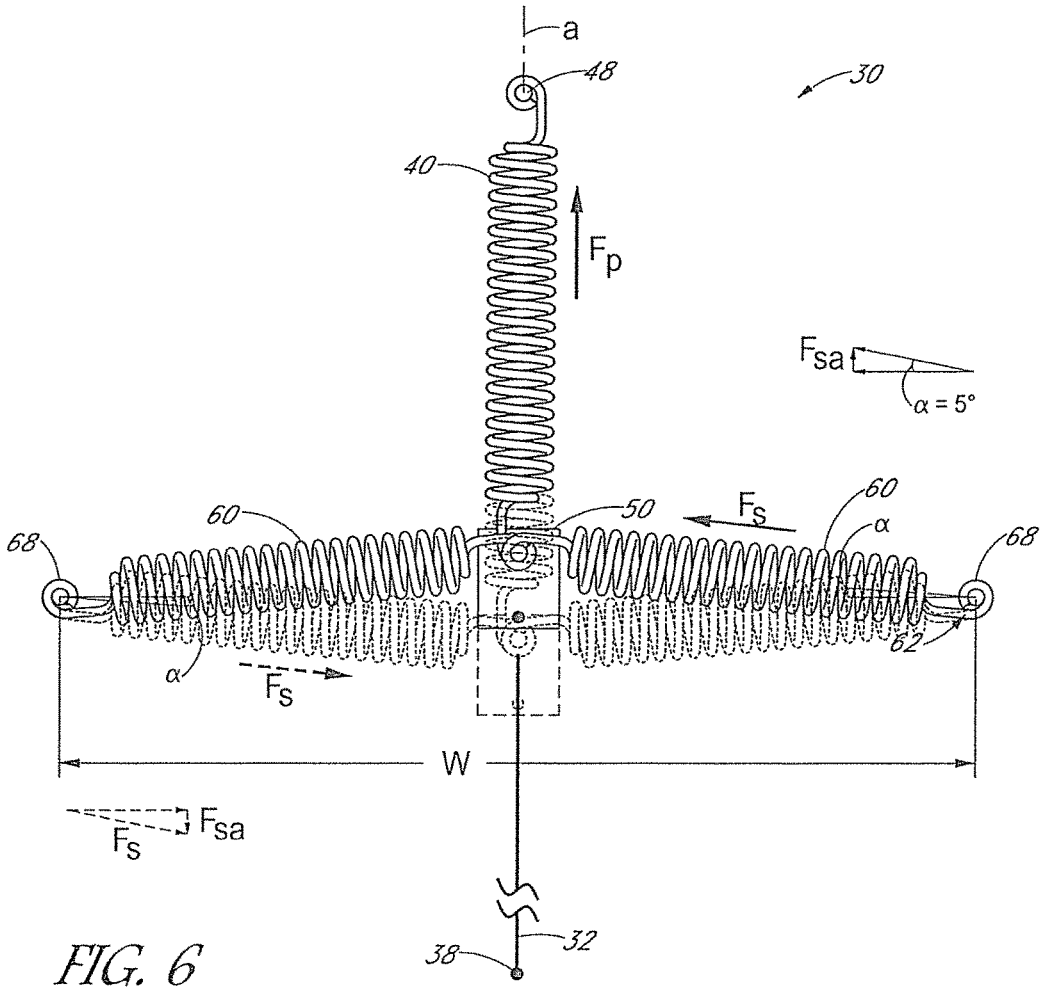
FIG. 6 shows a schematic representation of another spring arrangement in accordance with yet another embodiment.

With reference next to FIG. 6, in another embodiment, a primary, axially-directed spring 40 is attached to the carrier 50 and adapted to supply a primary spring force Fp to a wire 30, which is also attached to the carrier 50, in a manner similar to the embodiment of FIG. 2. In FIG. 6, opposing identical secondary springs 60 are arranged as the springs 60 are in FIGS. 3-5. In this embodiment, the primary spring 40 follows Hooke's law and thus has a constant spring rate k. As shown, the secondary springs 60 are disposed in a range of α=0±5°, in which the axial component of Force Fsa of the secondary springs 60 is a function of sin α, which is a nearly-linear function at small angles such as α=0±5°. As such, in a preferred embodiment, the secondary springs 60 can be selected to have a spring constant so that their axial force component Fsa generally follows and compensates for the linear reduction of the primary axial spring force Fp as the carrier 50 moves axially when the wire 30 (or musical string in some embodiments) stretches or contracts over time. As such, the tension Tw in the wire 30 remains generally the same during such stretching or contracting. In a preferred embodiment, such force compensation operates within an operational range, such as α=0±5°. Depending on the requirements of the application, the operational range may be narrower, such as α=0±3°, or larger, such as within α=0±10°, α=0±15°, or even α=0±20°.

With continued reference to FIG. 6 and reference again to Table 2, in a preferred embodiment, since the spring rate of each secondary spring 60 at and around α=0° approaches 90 lb./in., the total spring rate of the two secondary springs 60 combined approaches 180 lb./in. In one such embodiment, the primary spring 40 is selected to have a spring rate of −180 lb./in. As such, in the operational range of about α=0° relative to the opening, the primary spring 40 has a spring rate of about −180 lb./in. in tension, while the secondary springs combine to provide an axial spring rate in compression of about 180 lb./in. The combined spring rate, then, approaches zero, which results in the change in force applied by the tension device 28 approaching zero in the operational range about α=0°.

More specifically, in the embodiment depicted in FIG. 6 and Table 2, when the carrier 50 moves from α=0° to α=1°, it moves axially 0.017455 in. Thus, the tension applied by the primary spring 40 reduces by (180 lb./in)(0.017455 in.)=3.1419 lb. However, the axial component Fsa of force provided by the two secondary springs 60 is 2(1.57048 lb.)=3.1410 lb. Thus, the net change in tension as the carrier 50 moves from α=0° to α=1° is only 0.0009 lb. With additional reference to Table 3, the net axial spring rate ka for α=0±5° is calculated by adding the combined axial spring rate of the secondary springs 60 to the primary spring rate (here 180 lb./in.).

TABLE 3

| Alpha (deg) | Net Spring Rate |
|---|---|
| 5 | −4.9630 |
| 4 | −3.3328 |
| 3 | −2.0244 |
| 2 | −1.0407 |
| 1 | −0.3837 |
| 0 | −0.0548 |
| −1 | −0.0548 |
| −2 | −0.3837 |
| −3 | −1.0407 |
| −4 | −2.0244 |
| −5 | −3.3328 |

In view of Table 3, over a range of $\alpha=-4°$ to 4°, the net axial spring rate ka averages about −1.15 lb./in. Over a range of a range of $\alpha=-5°$ to 4°, the net axial spring rate averages about −1.37 lb./in. Over a range of $\alpha=-5°$ to 5°, the net axial spring rate averages about −1.69 lb./in.

Figure 7:
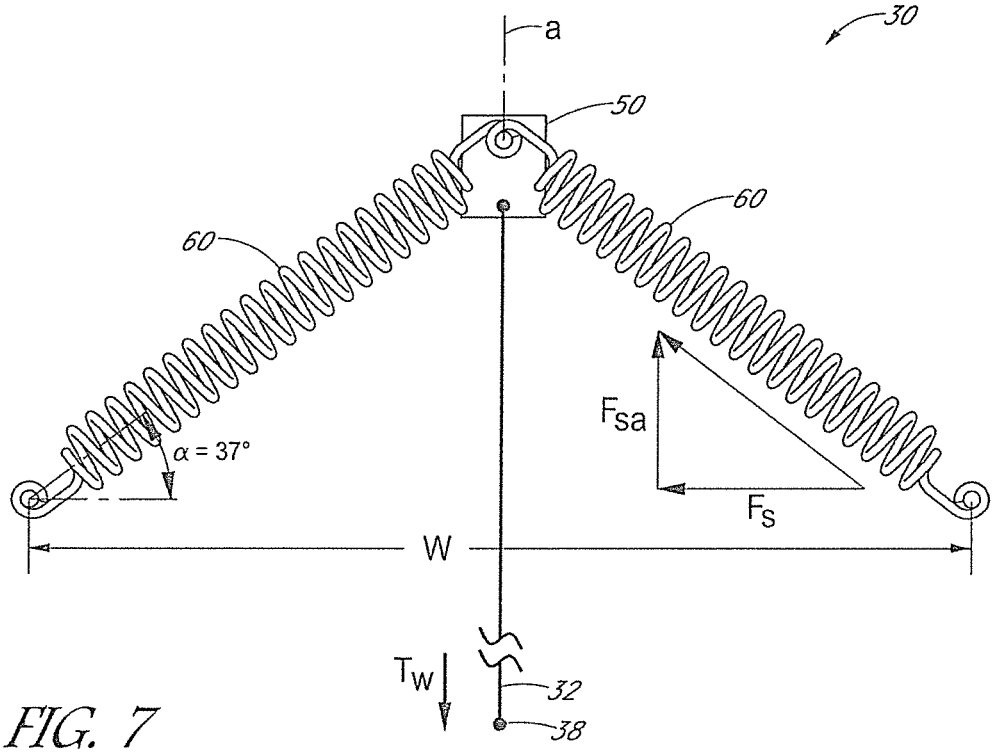
FIG. 7 shows a schematic representation of still another spring arrangement in accordance with another embodiment.

With reference next to FIG. 7, in another embodiment the operational range of a spring-based tension device 28 can be arranged to straddle the zone of zero spring rate, at which the spring rate transitions from a negative spring rate to a positive spring rate. Since the magnitude of spring rate reverses in this range, the net average spring rate can be constrained within a desired range. As such, the change in the net axial force component of the secondary springs in the operational range encompassing the zero spring rate transition can approximate the change in primary spring force as the carrier moves through this zone. An operational range thus can be defined about the angle corresponding to the point of zero spring rate. In the embodiment described in the table, the spring rate approaches zero at about $\alpha=37°$. In some embodiments an operational range is defined ±1°, ±2°, ±4°, $\alpha=0\pm5\text{-}7°$ or about ±10° about the angle of zero spring rate. At the position of zero spring rate, incremental changes in axial position incur no change in force applied. Thus only the springs 60 are needed in this embodiment.

Figure 8:
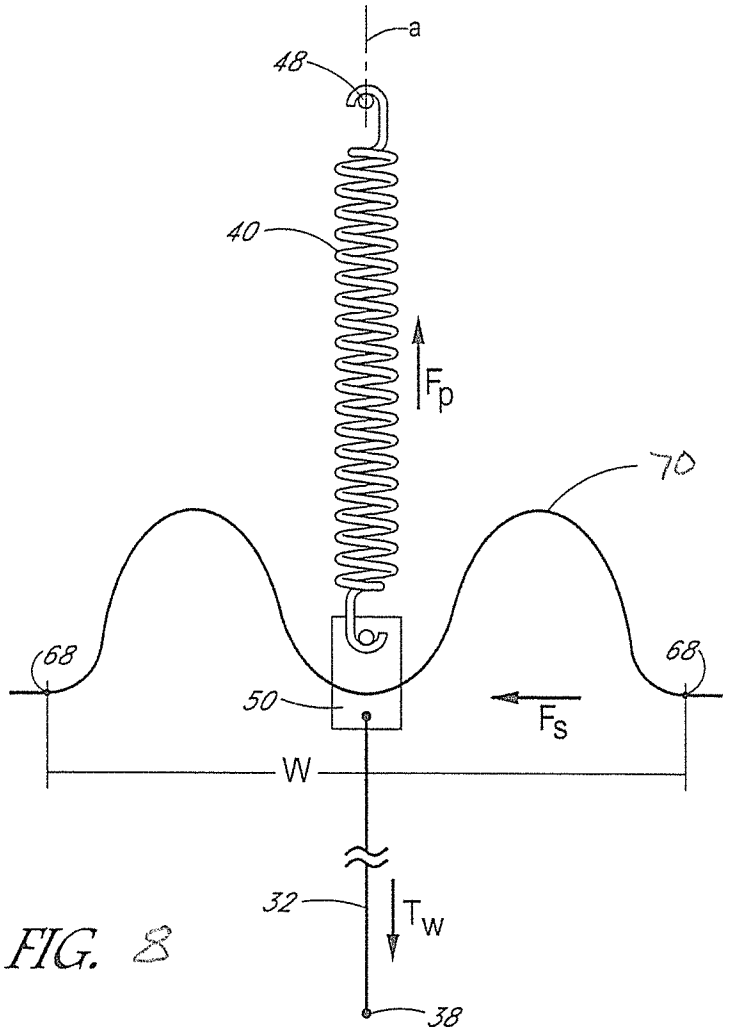
FIG. 8 is a schematic representation of a spring arrangement configured in accordance with yet another embodiment.

With reference next to FIG. 8, another embodiment is schematically represented in which a primary spring 40 comprises a coil spring held in tension and connected to the string 30 via a carrier 50 configured to move linearly along the axis a. A secondary spring 70 is constructed comprising a flat piece of spring steel having a length greater than a width w between spring mounts 68, to which the flat spring 70, or leaf spring, is attached. A center of the flat spring 70 is also attached to the carrier 50, and the flat spring 70 is compressed so that it fits within the width of the device. As shown, due to such compression the flat sheet 70 is deflected into two symmetrical curves, one on each side of the axis. As shown in FIG. 8, each curve provides a secondary spring force Fs in compression and directed transverse to the axis. In the illustrated embodiment the secondary spring force is directed in a direction in which $\alpha=0°$. As the string lengthens or contracts, the carrier 50 will move axially, and the secondary spring force will adopt an axial component Fsa that will at least partially compensate for the change in axial force exerted by the primary spring 40 as discussed above.

Figure 9:
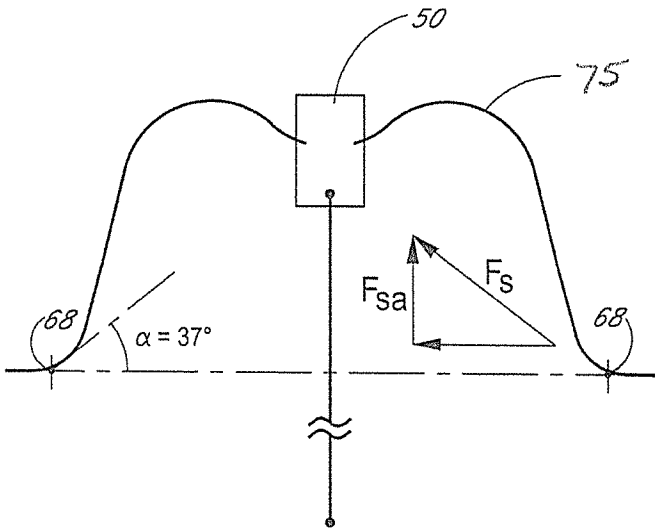
FIG. 9 is a schematic representation of a spring arrangement configured in accordance with still another embodiment.

With reference next to FIG. 9, in another embodiment, a flat spring sheet 75 of spring steel can be used to configure a tension device in with the secondary spring force is directed in a direction generally corresponding to the angle of deflection corresponding to the zero spring rate position. As discussed above in connection with FIG. 7, no primary spring is necessary in an embodiment operating around the zero spring rate position.

Figure 10:
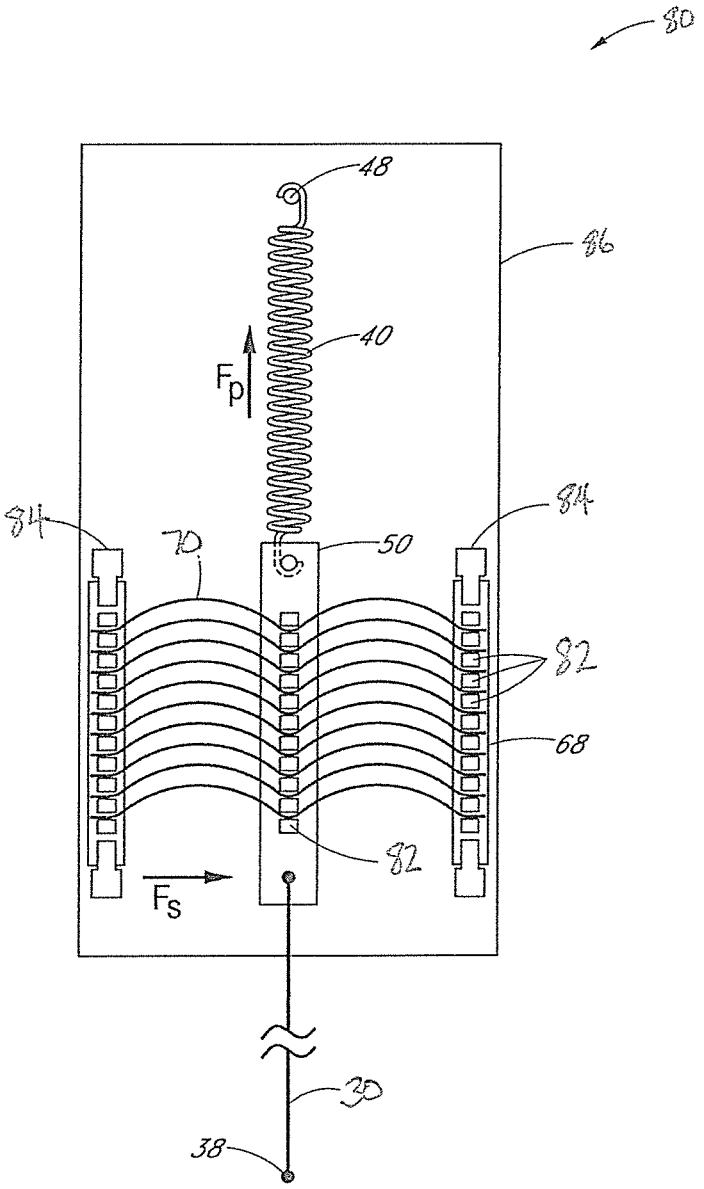
FIG. 10 shows an embodiment of a tension device employing features as in the embodiment illustrated in FIG. 8.

With reference next to FIG. 10, another embodiment is illustrated in which a tension device 80 employs a configuration resembling that of FIG. 8, except that multiple deflected flat sheets 70, or leaves, are provided to, in sum, provide the desired secondary spring forces Fs. In the illustrated embodiment the fixed string mounts 68 comprises spacers 82 to keep adjacent sheets 70 of spring steel spaced from one another, but held securing with in a clamp 84 of the mount 68. Similarly, in this embodiment the carrier 50 is elongate and comprises several spacers 82 that maintain a space between adjacent sheets 70 of spring steel. A clamp disposed on the carrier 50 also can hold the springs 70 and spacers on 62 in place. In some embodiments the spacers 82 comprise flat pieces of spring steel that can be replaced as needed or desired. In another embodiment layers of spring steel can be engaged with one another.

In the embodiment illustrated in FIG. 10, the multiple deflected sheets or leaves 70 of spring steel combine to provide a desired secondary spring force Fs. In the illustrated embodiment the primary coil spring 40 has a spring rate of 91 lb./in., and the secondary spring comprises 10 half-inch wide strips 70 of 3 mil thick spring steel. Half an inch of the length of each sheet is deflected within a space of about 0.3 inch between the carrier 50 and the mount 68. The mount preferably is incorporated into a frame 86 that, in the illustrated embodiment, has a width of about 0.66 in. total, a length of about 2.3 in., and a height of about 0.665 in.

Tension devices 80 as described herein may be particularly useful for applying tension to musical strings of musical instruments such as guitars. Thus, in some embodiments, a plurality of the tension devices 80 can be mounted side-by-side on a guitar.

Figure 11:
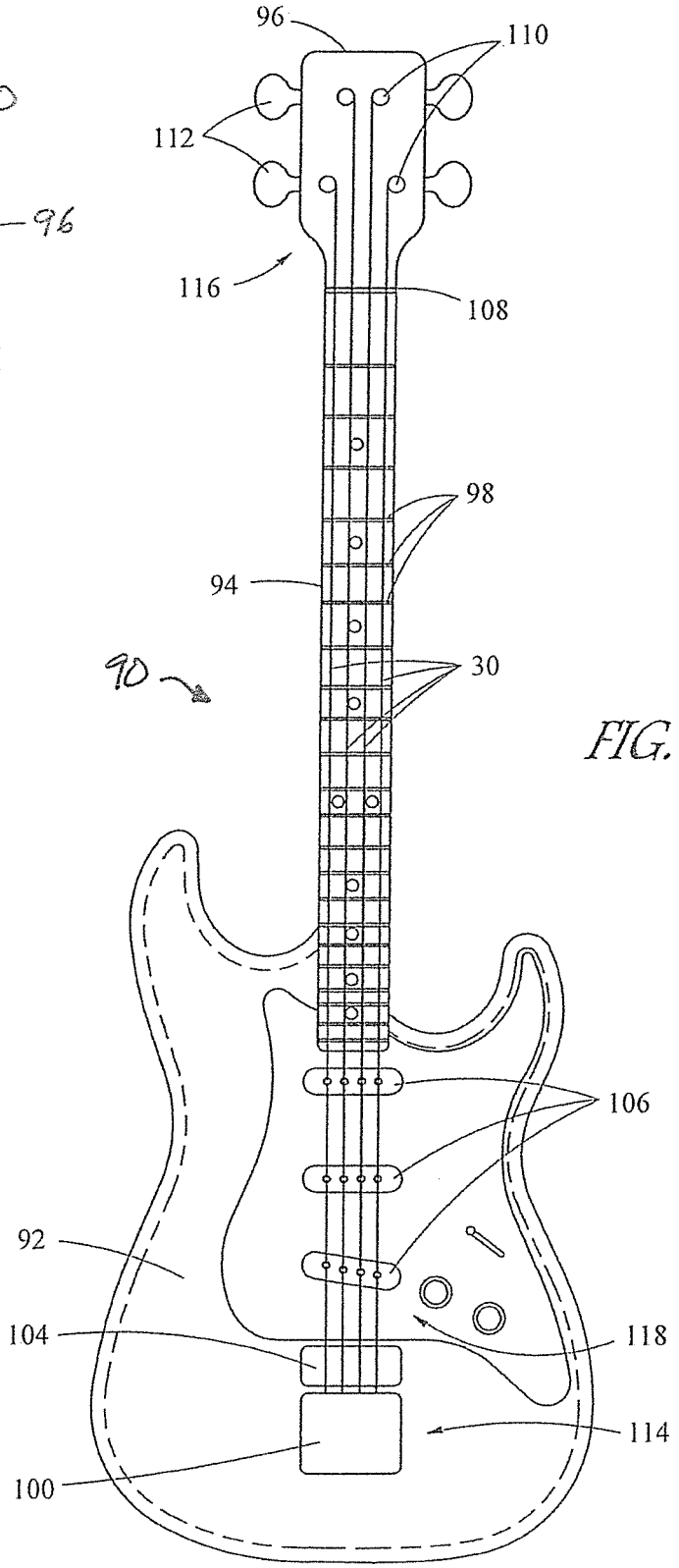
FIG. 11 is a plan view of a four-string bass electric guitar schematically incorporating a bridge module and string holder module in accordance with one embodiment.

With reference next to FIG. 11, a guitar 90 is illustrated. The illustrated guitar 90 comprises a body 92 from which an elongated neck 94 extends, which neck extends to a head 96. As is typical with guitars, frets 98 can be provided along the neck 94. Musical strings 30 traverse the body 92, neck 94 and head 96 of the guitar 90, and preferably are held in tension. More specifically, proximal ends of the strings 30 are held securely by a string holder module 100 and then pass over a bridge module 104. Pickups 106 on the body 92 are configured to sense string vibrations above the guitar body 92. The strings 30 traverse the neck 94, extend over a head nut 108, and are each wound about an axle 110, which axle 110 preferably is controlled by turning a corresponding tuning peg 112. As with conventional guitars, by turning the tuning pegs 112, and thus also turning the axles 110, each string 30 can be tightened to an appropriate tension corresponding to a desired string tune A body string connection zone 114 is defined proximal of the bridge module 104 and a head string connection zone 116 is defined distal of the nut 108. A playing zone 118 is defined between the bridge module 104 and nut 108. String vibrations in the playing zone 118 are isolated from string vibrations in the body connection zone 114 and head connection zone 116 by the bridge module 104 and head nut 108, respectively.

Figure 12:
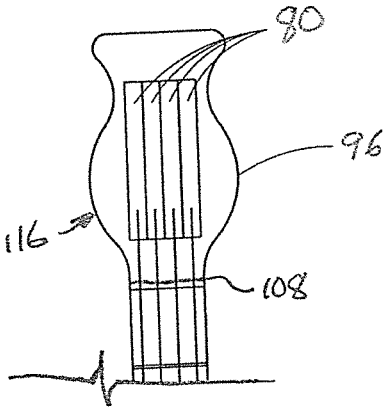
FIG. 12 is a partial view of a headstock portion of another embodiment of a bass guitar employing tension devices on a headstock of the guitar.

The frame width of 0.66 in. and the selected spring rate discussed above in accordance with the embodiment of FIG. 10 approximates the spacing between strings in a typical electric bass guitar, and the desired force of an example bass guitar string. With reference next to FIG. 12, a plurality of tension devices 80 are depicted mounted on a headstock 96 of a bass guitar 90, with each tension device 80 dedicated to providing tension to a corresponding musical string 30. One end of the string 30 is secured to a bridge supported on the body 92 of the guitar 90. The other end of the string 30 is attached to a corresponding one of the tension devices 80.

In the embodiments discussed above in connection with FIGS. 8-10 and 12, the spring sheets or leaves are rigidly connected to the mounts and carrier, and thus are considered a solid-state system in which the components are not movable relative one another. As such, there is little or no external friction. Also, even if the tension device is exposed to outside elements such as dirt and grime, such elements will not substantially affect spring function. It is to be understood that embodiments employing other types of springs, including coil springs, bar springs, etc., can be configured so that the springs are rigidly connected to the mounts and carrier.

Embodiments can function as, and be placed as, the bridge of a guitar or other stringed instrument. In other embodiments, constant-tension devices such as discussed herein can be placed on the headstock of a guitar (electric or acoustic), violin, cello or other stringed instrument, including acoustic versions of such instruments, thus keeping the components spaced from the body of the instrument. Notably, suitable stringed instruments for incorporating tension devices as discussed herein also include pianos, mandolins, steel guitars, and others.

The "cent" is a logarithmic unit of measure used for musical intervals. More specifically, one cent is 1/100 of the difference in frequency from one note to the next in the 12-note chromatic scale. In this scale there are twelve notes in each octave, and each octave doubles the frequency so that 1200 cents doubles a frequency. As such, one cent is precisely equal to 2^(1/1200) times a given frequency. Since frequency is proportional to the square root of tension, one cent is also equal to a tension change by 2^((1/1200)*2)= 2^(1/600) from one tension value to a tension value one cent away. 2^(1/600)−1=1/865 (0.001156). Thus, every change in tension by 1/865 (0.001156) equates to one cent different in frequency. Similarly, every change in tension by 1/86 (0.01156) equates to a ten cent difference in frequency, and every change in tension by 1/173 (0.00578) equates to a five cent difference in frequency.

In one embodiment, the operation range of the tension device configured to be used with a stringed musical instrument is selected to correspond to a change in frequency of ten cents or less per 1 mm of travel. In another embodiment, the operation range of tension device is selected to correspond to a change in frequency of five cents or less per 1 mm of travel. The actual length of the operation range can vary, but in some embodiments is up to about 1 mm of travel. In other embodiments, the operation range is up to about 1-1.5 mm of travel. In still further embodiments, the operation range is up to about 2 mm of travel.

With reference again to FIG. 6 and Table 3, in one embodiment the range of 10° from $\alpha=-5°$ to $\alpha=4°$ corresponds to a total distance of displacement of 0.175 inches and an average spring rate of 1.37 lb./in. Thus, the change in tension from one side of this range to the other is 0.24 lb., which is 0.24 lb./180 lb.=0.001332 change in tension, which corresponds to about 1.15 cents, which is well within the desired range, and is within a range that will not be aurally detectable by the human ear.

To determine a maximum desired change in tension to define a desired operational range of, for example, 10 cents, a string tension is multiplied by the value of 10 cents change infrequency. For example, for a guitar string designed for a tension of about 10 pounds, a change in tension corresponding to ten cents of frequency is calculated as 10 lb.*(01156)= 0.12 lb.

Figure 13:
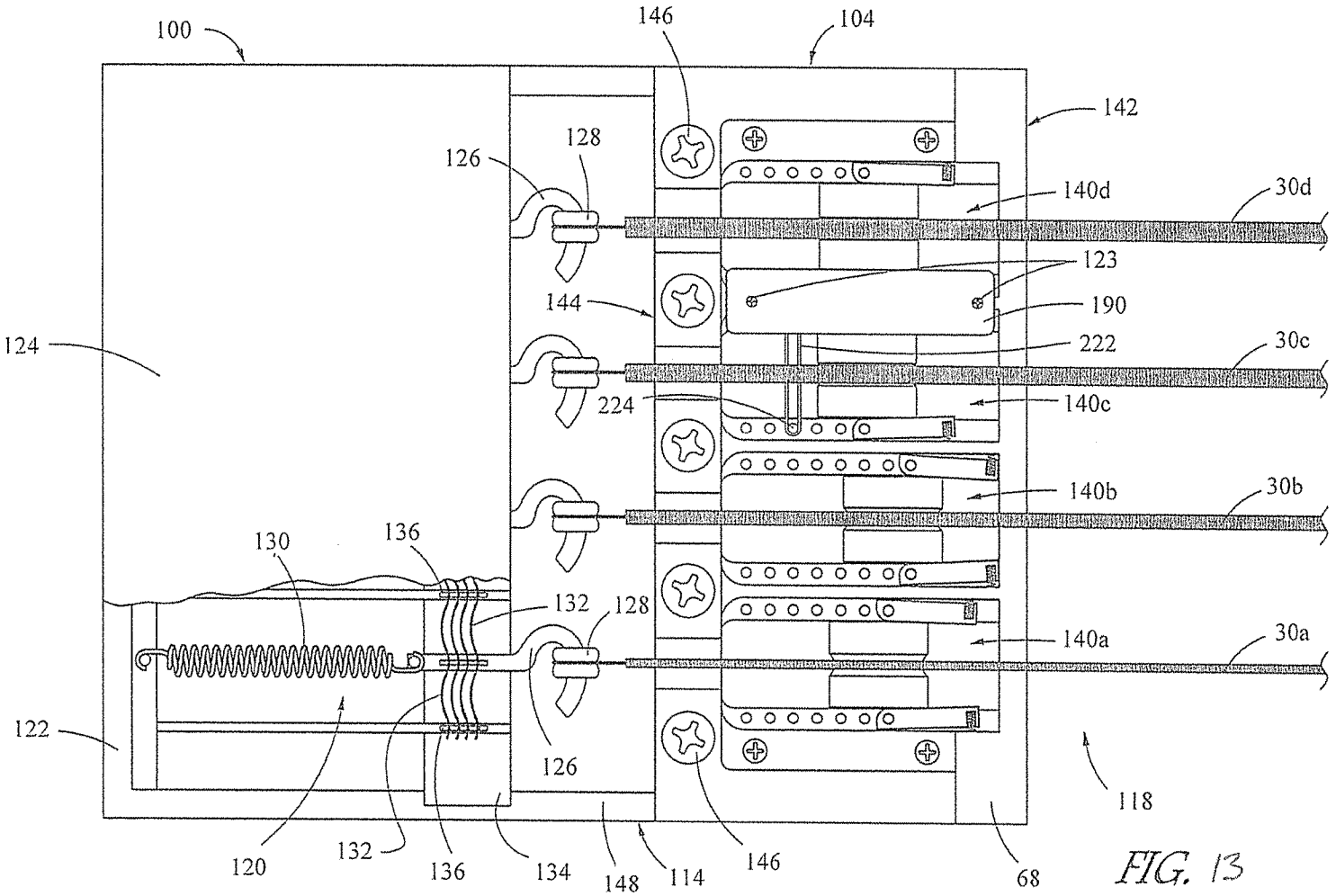
FIG. 13 is a close-up view of a bridge module and string holder module in accordance with an embodiment.

With reference next to FIG. 13, an embodiment of a bridge module 104 and string holder module 100 is shown. The illustrated string holder module 100 includes a plurality of string tensioners 120, one string tensioner 120 corresponding to each musical string 30. The illustrated string tensioner 120 preferably comprises a constant tension device such as is originally disclosed in Applicant's co-pending U.S. application Ser. No. 14/476,619, which is incorporated herein by reference in its entirety. In this embodiment, multiple string tensioners are enclosed within and supported by a string holder module frame 122. As shown in FIG. 13, a plate 124 preferably covers the string tensioners. However, FIG. 13 has a portion of the plate 124 cut away to illustrate an exemplary string tensioner 120.

In the illustrated embodiment, each string tensioner 120 comprises a connector 126 at its distal end to which a string ball 128 is attached. The string ball 128 is at the proximal end of each musical string 30, and functions to connect the string 30 to the tensioner 120. The string tensioner includes a primary spring 130 that is connected at its distal end to the connector 126 and at its proximal end to the frame 122. Preferably, the primary spring 130 is held in tension and longitudinally aligned with the string 30. As such, the primary spring 130 applies a longitudinal tension force to the attached musical string 30. In the illustrated embodiment, a plurality of secondary springs 132 which, in the illustrated embodiment, comprise thin metal sheets, are attached to the connector 126 and to a secondary frame 134. The secondary frame includes a plurality of stationary spring mounts 136 configured to hold the secondary springs 132.

As discussed above, the primary spring 130 is held in tension and correspondingly applies tension to the attached string 30. However, as the string 30 stretches and contracts over time, the primary spring 130 will correspondingly stretch or contract, thus changing the tension applied by the primary spring 130 to the string 30. The secondary springs 132 are configured to apply a force to the connector. However, only a portion of this force is directed as a force vector in a longitudinal direction. Preferably, the longitudinally-directed vector force changes as the primary spring 130 elongates and contracts. Also, the secondary springs 132 are chosen so that the variation in the longitudinal force vector generated by the secondary springs generally corresponds to the change in longitudinal force applied by the primary spring 130 so that the secondary and primary springs, taken together, apply a constant or near-constant longitudinally-directed tension force to the corresponding string 30 over a range of operation.

In such embodiments, as the string 30 stretches and contracts, the string tensioner 120 will maintain a constant or near-constant tension in the string, however, the string 30 will move. For example the position of the string ball 128 may move proximally or distally, and correspondingly the string 30 will move over the bridge 104. Excessive friction in the bridge could dilute the effectiveness of the string tensioner 120 in keeping tension in the string 30 at a constant or near-constant level.

In the illustrated embodiment, the string tensioner 120 has structure as illustrated. However, it is to be understood that other string tensioner configurations can be employed, including other embodiments of tensioners that apply a constant or near-constant force over an operational range. For example, Applicant's issued U.S. Pat. No. 7,855,330 discloses embodiments of constant tension devices that can maintain musical strings at a constant or near-constant tension in order to maintain string tune. Embodiments as disclosed in the '330 patent, closure of which is incorporated by reference in its entirety, can also be employed as a string tensioners. Still further, some string holder module embodiments may not adjust with the strings, but may more traditionally hold the string balls at a constant, fixed position. Such traditional embodiments may still benefit from the principles and aspects discussed herein.

With continued reference to FIG. 13, a bridge module 104 comprises a plurality of races 140*a-d*, each race corresponding to a corresponding string 30*a-d*. As shown, the bridge module 104 comprises a distal end 142 and a proximal end 144. A plurality of screws 146 attach the bridge module 104 to the guitar body 92. In the illustrated embodiment, the bridge module 104 and string holder module 100 share a common frame 148. In other embodiments, however, the bridge module 104 and string holder module 100 can be formed and attached to the guitar body independently of one another.

Figure 14:
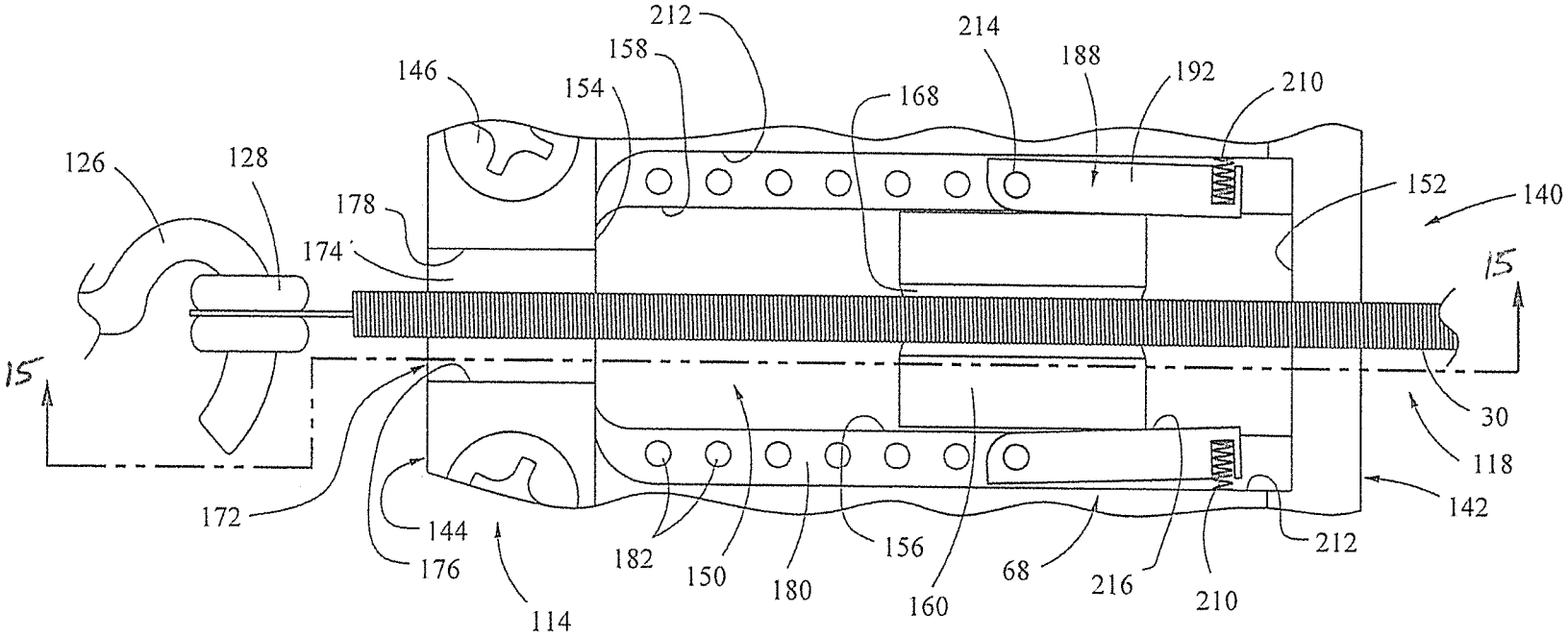
FIG. 14 is a top, plan view of a portion of the bridge module of FIG. 13.
Figure 15:
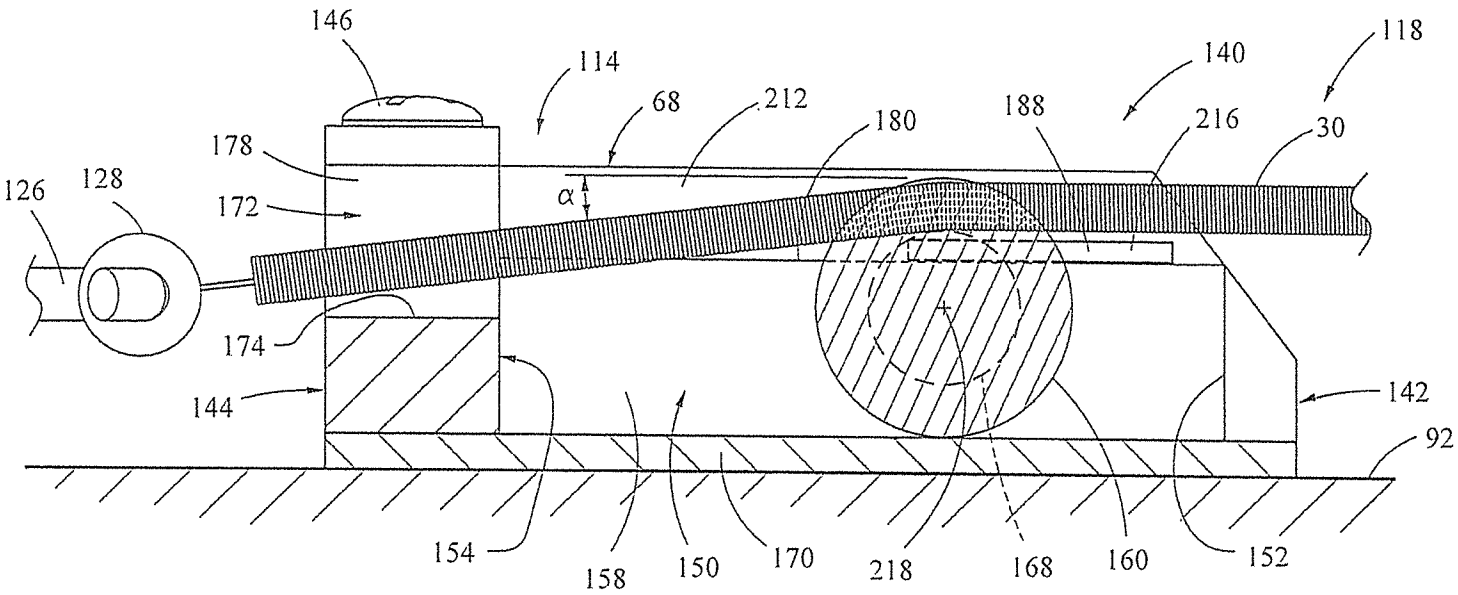
FIG. 15 is a side view taken along lines 15-15 of FIG. 14.

With reference next to FIGS. 13-15, each race 70 comprises an elongated channel 150 defined by a distal channel wall 152, proximal channel wall 154 and first and second channel side walls 156, 158. A roller saddle 160 is fit within the elongated channel 150 and is configured to roll therewithin.

Figure 16:
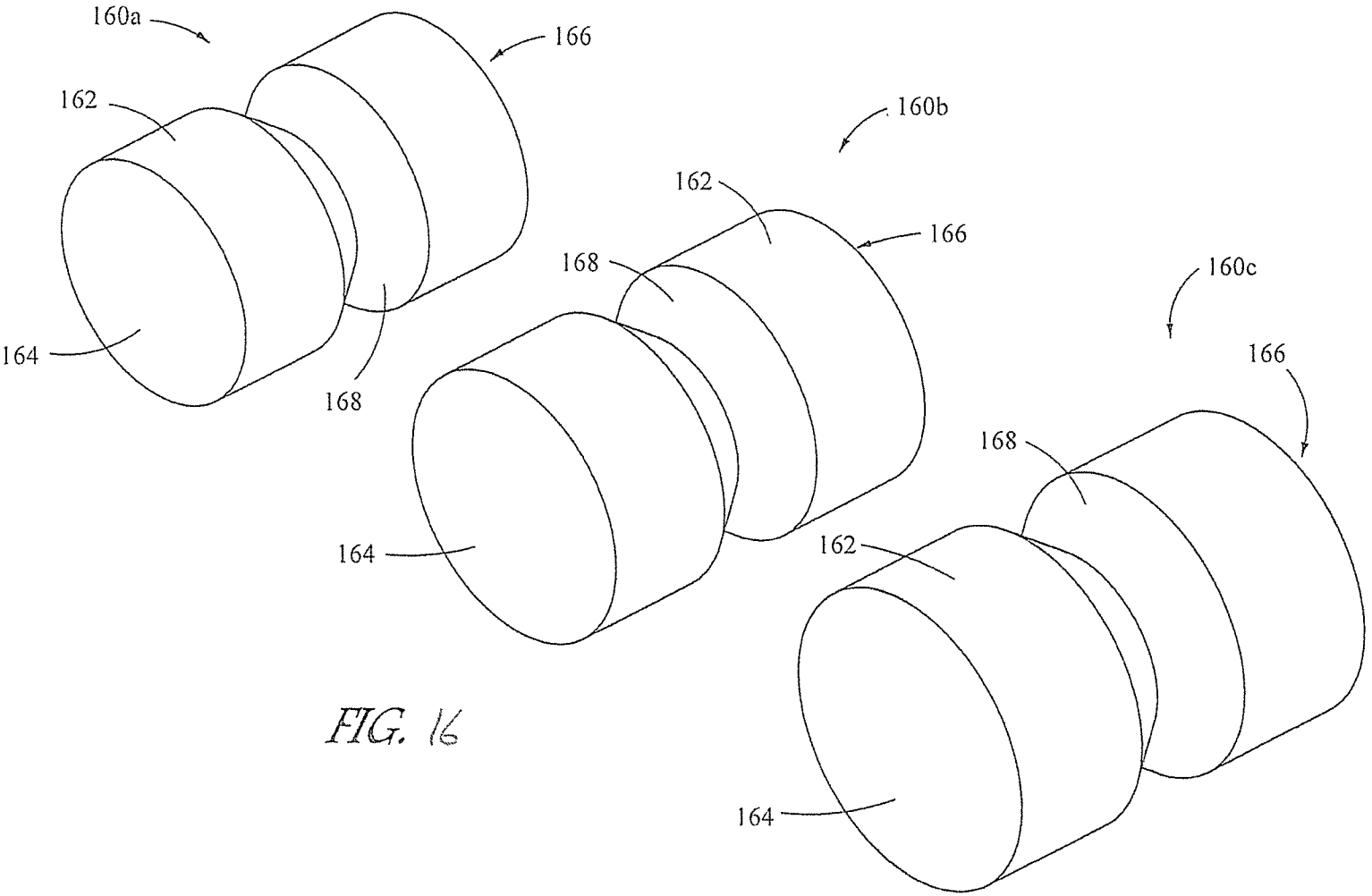
FIG. 16 shows perspective views of roller saddles having features in accordance with some embodiments.

With additional reference to FIG. 16, each roller saddle 160 comprises a cylindrical body 162 and first and second side faces 164, 166. A circumferential groove or saddle 168 is formed in the cylindrical body 162. In the illustrated embodiment, the groove is generally V-shaped. Other shapes, such as U-shaped or the like, can also be employed. Preferably, the saddle 168 is configured to receive a string 30 seated therein.

With particular reference again to FIGS. 14 and 15, the bridge module 104 preferably includes a base plate 170. The roller saddle 160 thus is configured to roll atop the base plate 170 and within the elongated channel 150. A slot 172 is formed at a proximal end of the channel and is defined by a bottom surface 174 and opposing first and second side walls 176, 178. A string 30 extends from the playing zone 118 over the distal wall 152 and is supported in the saddle 168 of the roller saddle 160. From the saddle 168, the string 30 extends proximally through the slot 172 and proximal of the bridge module 104 until the string ball 128 is attached to the tensioner connector 126. As such, in the illustrated embodiment the roller saddle 160 separates the body connection zone 114 from the playing zone 118.

Preferably, a width of the elongated channel 150 between the first and second channel side walls 156, 158 approximates a width of the roller saddle 160, but enables the roller saddle 160 role within the channel 150 unobstructed by the channel side walls 156, 158. Preferably, the roller saddle 160 rolls on the base plate 170. However, in other embodiments, the roller saddle may ride over and be supported upon the surface of the guitar body 92.

As discussed above, the string 30 is seated in the groove/saddle 168. Since the roller saddle 160 readily rolls on the base plate 170, when the string 30 expands and contracts, the roller saddle 160 will roll to accommodate such movement and the string 30 will not slide relative to the surface of the saddle 168. As such sliding friction of the string 30 over the saddle 168 is minimized or totally avoided in favor of rolling friction of the roller saddle 160 over the base plate 170, which is much less than sliding friction.

Most preferably, the roller saddle 160 is formed of a solid block of a choice vibrational material such as bronze, brass or titanium. Preferably, the base plate 170 is also formed of a choice vibrational material. As such, resonance from the vibrating string 30 is easily transferred through the roller saddle 160 and base plate 170 to the guitar body 92, and back to the string 30.

As discussed above, accomplished guitarists wish to adjust the length of each guitar string 30 in order to attain proper tuning. Such length adjustment, known as intonation, typically involves independent positioning of each bridge member to set the desired length for the corresponding guitar string. In operation, a user may first select the desired intonation location of the roller saddle 160 by placing the roller saddle within the elongated channel 150 and rolling and/or pushing it to a desired position for intonation. Once intonation is completed, and the string has been put in place and is under tension, the roller saddle can operate normally, rolling with very low friction as the string stretches or contracts. Indeed, preferably, the roller saddle experiences no sliding-based friction, and only experiences the relatively-low rolling friction.

As discussed above, in the illustrated configuration, as the string 30 stretches or contracts a given length, the roller saddle will rotate. In fact, the rotating roller saddle will translate longitudinally to a lesser extent that the string translates longitudinally. As such, the roller saddle configuration dampens the effect string translation may have on intonation positions, and the saddle 168 translates less than does the string.

A user may also wish to adjust the height of the strings 30 relative to the guitar body 92. To this end, preferably a base plate 170 is selected having a thickness that will place the strings 30 at or near a desired height above the guitar body 92. With additional reference to FIG. 16, a user can then select a desired roller saddle size. More specifically, a kit may be provided, which kit may include the bridge module 104 and multiple sets of roller saddles, each set of roller saddles having a different radius. For example, with particular reference to FIG. 16, a first set of roller saddles 160*a* has a first radius R1, a second set of roller saddles 160*b* has a second radius R2 that is nominally greater than the first radius R1, and a third set of roller saddles 160*c* have a third radius R3 that is nominally greater than the second radius R2. The user can select the set of roller saddles having a radius corresponding to the desired height. The user can also select different sizes of rollers for particular strings so that each string can be at a desired height. In some embodiments, the kit may also or instead include multiple base plates, each having a different thickness. Thus by selecting a particular base plate and/or a particular set of roller saddles, a user may configure his bridge module 104 to have a desired height.

It is to be understood that, in other embodiments, height adjustment can be accomplished by other structures. For example, the bridge module may include screws that adjust the height of the entire module relative to the guitar body.

With particular reference again to FIGS. 13-15, as discussed above, the roller saddle 160 fits complementarily within the elongated channel 150 so that it can roll therein. During use, vibration in a plucked string 30 is communicated to the corresponding roller saddle 160. Such vibration includes a side-to-side component that carries the risk of generating a buzzing sound with the channel.

As shown, each race 140 additionally includes a pair of support surfaces 180 atop each channel side wall 156, 158. Spaced apart adjustment holes 182 preferably are formed through each support surface 180.

Figure 17:
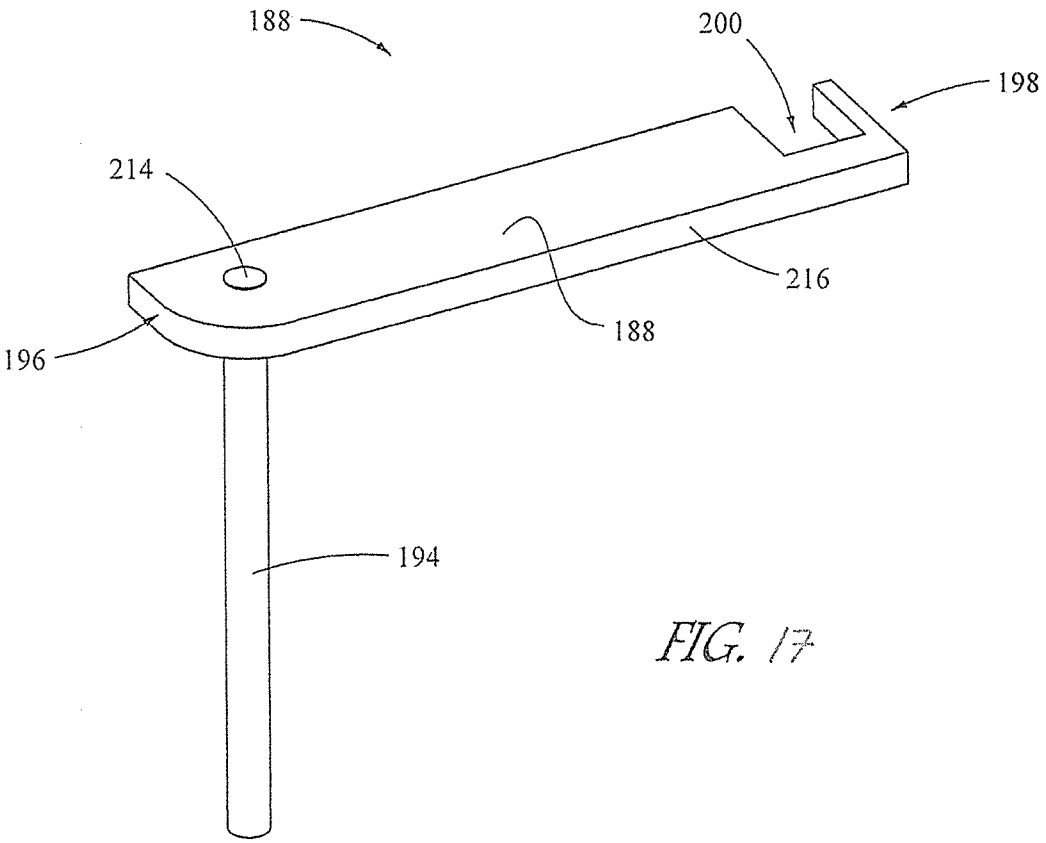
FIG. 17 is a perspective view of a contact member for use in the bridge module embodiment of FIGS. 13-15.

With additional reference to FIG. 17, a contact member 188 comprises an elongated bar 192 having a proximal end 196 and a distal end 198. The elongated bar 192 is connected to an elongated pin 194 near a proximal end 196 of the bar 192. A receiver 200 is formed as a cavity at or adjacent a distal end 198 of the bar.

With continued reference again to FIGS. 14 and 15, the pin 194 of the contact member 188 fits into any of the adjustment holes 182. Preferably, and as shown in FIG. 14, the contact member 188 is placed so that the proximal end 196 of the contact member is at or adjacent a side surface 164, 166 of the roller saddle 160, and the distal end 198 of the elongated bar 192 is positioned distal of the roller saddle 160.

In the illustrated embodiment, a biasing member 210, such as a small coil spring, extends into each receiver 200 and engages a race side wall 212 so as to urge the elongated bar 192 to rotate about a pivot point 214, and thus bias a contact surface 216 of the contact member 188 against the corresponding side face of the roller saddle 160.

In the embodiment illustrated in FIG. 14, each race 70 includes opposing first and second contact members 188 that are mirror images of one another and which engage opposing first and second side faces 164, 166 of the roller saddle 160.

With additional reference to FIG. 15, preferably each elongated bar 192 of each contact member 188 is positioned above a rolling axis 218 of the roller saddle 160 and is at or near the level of the corresponding string 30. In some embodiments, the contact member 188 is slightly below the corresponding string 30; in other embodiments the contact member 188 is slightly above the corresponding string 30; and in further embodiments the contact member 188 is at least partially aligned with or at the same height as the corresponding string 30. Preferably, the corresponding roller saddle 160 is squeezed between the opposing contact members 188 with a biasing force in the range of up to about 4 pounds, more preferably between 0.5 and 3 pounds, and most preferably about 1 pound. As such, side-to-side vibrations that would tend to cause buzzing are dampened or prevented from causing buzzing as a string is plucked.

The user can change the position of the contact members 188 by pulling upward on the elongated bar 192 so that the pin 194 is removed from its associated hole 182. The user can then insert the pin 194 into another one of the holes 182 as desired. Preferably, the contact members 188 on opposite sides of the channel 150 are inserted into symmetrically aligned holes 182 so as to exert a symmetrical biasing force on the associated roller saddle 160. In additional embodiments, a detent structure can be provided on the pin 194 or holes 182 so that the pins 194 do not slide out of holes 182 unintentionally.

In some embodiments, a cover can be attached atop the support surface 180 to prevent the contact members 188 from falling out of the holes. With reference again to FIG. 13, such a cover 190 is shown placed atop the frame 68 and secured with screws 123 after contact members 188 have been positioned as desired. The cover 190 prevents the contact members 188 from sliding out of the holes 182.

In the illustrated embodiment, the elongated bars 192 rest upon support surface 180. In additional embodiments, one or more of the contact members can include a pin that is longer than the corresponding holes 182 so that when the pin is inserted into the hole the elongated bar 192 will be spaced from the support surface 180.

In the illustrated embodiment, the contact members 188 are positioned relative to the associated roller saddle 160 so that the pivot point 214 is near a center of the roller saddle and most preferably proximal of a center of the roller saddle 160, while the distal end 198 of the elongated bar 192 is positioned distal of the roller saddle 160. As such, the elongated bar 192 pivots inwardly a small amount to take up play that may exist between the side faces 164, 166 of the roller saddle 160 and the channel side walls 156, 158 in order to minimize or prevent buzzing.

In the illustrated embodiment, each of the elongated bar 192 on opposite sides of the channel pivot inwardly. In additional embodiments, the elongated bar 192 on only one of the sides may pivot, while the opposing elongated bar remains stationary. In still further embodiments, only a single contact member is employed, biasing the roller saddle from only one side of the channel. Preferably, the opposing channel wall can be lined with a low-friction material, such as Teflon-infused Delrin. The contact member thus biases the roller saddle into contact with the low-friction material lining the channel wall, thus minimizing or eliminating buzzing during operation.

With particular reference to FIG. 15, the string ball 128 attaches to the connector 126 at a point lower than, or closer to the guitar body than, the position at which the string 30 is supported by the saddle 168. In this arrangement the string 30 exerts a downwardly-directed force on the roller saddle 160, which force helps keep the string 30 and roller saddle 160 in place and also keeps the string 30 firmly engaged with the saddle 168 so that any vibrations in the string 30 in the body connection zone 114 are kept separate from string vibrations in the playing 118.

A break angle $\alpha$ is defined as the angle between the string 30 proximal of the saddle 168 and the string 30 distal of the saddle 168. Notwithstanding the benefits of the force exerted by the string 30 onto the roller saddle 160 by virtue of the break angle $\alpha$, because of the break angle $\alpha$, a longitudinally-directed vector force exerted by the string 30 tends to urge the roller saddle 160 longitudinally in a distal direction. Of course, a friction force between the roller saddle 160 and the base plate 170 provides some resistance against the longitudinally-directed break angle vector force. However, there is a risk that, when the string 30 and roller saddle 160 are vibrating, the longitudinally-directed break angle vector force may cause the roller saddle 160 to slide distally over the base plate 170, possibly moving the roller saddle 160 out of the selected intonation position. However, the biasing force exerted by the opposing contact members 188 also exerts a longitudinally-directed vector force component directed proximally in opposition to the break angle vector force, and thus resists the break angle vector force.

Additionally, if the string 30 is de-tensioned, such as by a string breaking, the biasing force exerted by the opposing contact members 188 will tend to hold the roller saddle 160 in its position. Thus, the user will not have to start from scratch in finding and setting the proper intonation upon restringing the guitar 90. Also, the roller saddle 160 will tend not to fall out of the channel 150 upon de-tensioning of the corresponding string 30 because it is held in place by the contact members 188.

Figure 18:
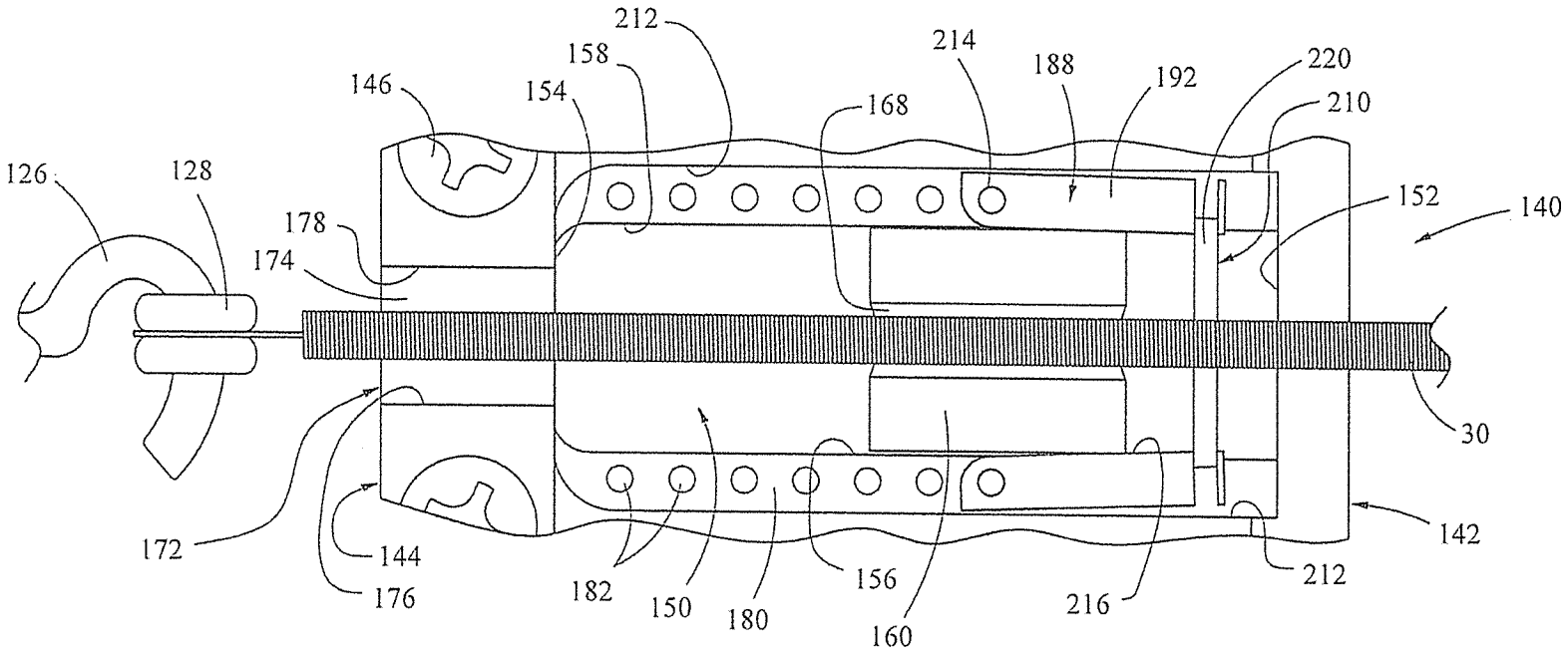
FIG. 18 is a top, plan view of a portion of another embodiment of a bridge assembly.

With reference next to FIG. 18, another embodiment is illustrated in which the biasing member 214 of the contact members 188 comprises an elastic band 220 that extends between the receivers 200 of the opposing contact members 188. Preferably, the elastic band 220 is selected to have a relaxed state somewhat smaller than the distance between opposing contact members 188 so that it is stretched in order to be received in opposing receivers 200 so as to exert a proper biasing force when connected. In additional embodiments, a plurality of sets of elastic bands 220, each set being configured to apply a different biasing force when attached to opposing receivers 200, can be included in a kit to enable the user to select a preferred biasing force for the contact members 188.

With reference again to FIG. 13, in some embodiments a second elastic band 222 can be stretched across the channel 150 proximal of the roller saddle 160. In such embodiments, secondary pins 224 can be placed in holes 182 on opposing sides of the channel, and the second elastic band 222 can be stretched across the secondary pins 224 to prevent the roller saddle 160 from rolling or sliding excessively proximally during use. In other embodiments, the second elastic band 222 can be placed so as to be in actual contact with the roller saddle.

In a preferred embodiment, the contact members 188 are constructed of a low friction material so that even though the contact members are exerting a biasing force on the side faces 164, 166 of the roller saddle 160, the roller saddle can still roll with minimal friction being exerted by the contact members 188. In one preferred embodiment, the elongated bars 192 are formed of a Teflon-infused Delrin material having a very low coefficient of friction, such as within a range of less than about 0.2, and more preferably between about 0.07-0.14 so that, when combined with the biasing force, there will be less than 10 cents of change in aural tone when the string is loaded at about 30 pounds of tension. In another embodiment, the elongated bars 192 are formed of a choice vibrational material such as is used for the roller saddle.

In the embodiments illustrated herein and discussed above, the contact members 188 are configured to pivot while exerting a biasing force on the side faces of the roller saddle. Additional embodiments may employ different structure to exert a biasing force on one or more side faces of the roller saddle. For example, in another embodiment the contact member can comprise an elongate bar that traverses all or much of the length of the channel, and is biased inwardly so as to be biased inwardly against a side face of the roller saddle in any position of the roller saddle along the length of the channel. Such biasing can be provided by springs such as coil springs, torsion springs, flat springs, leaf springs or the like, or by other materials such as elastomers in compression or tension.

Figure 19B:
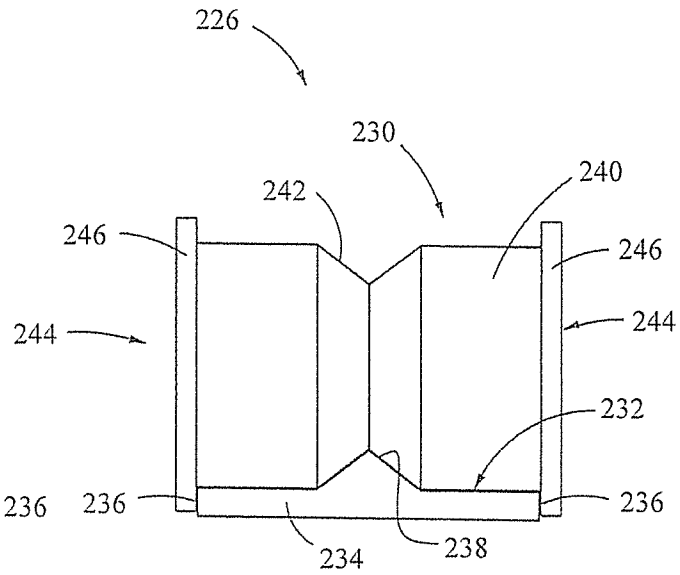
FIG. 19B is a front plan view of the embodiment of FIG. 19A.
Figure 19A:
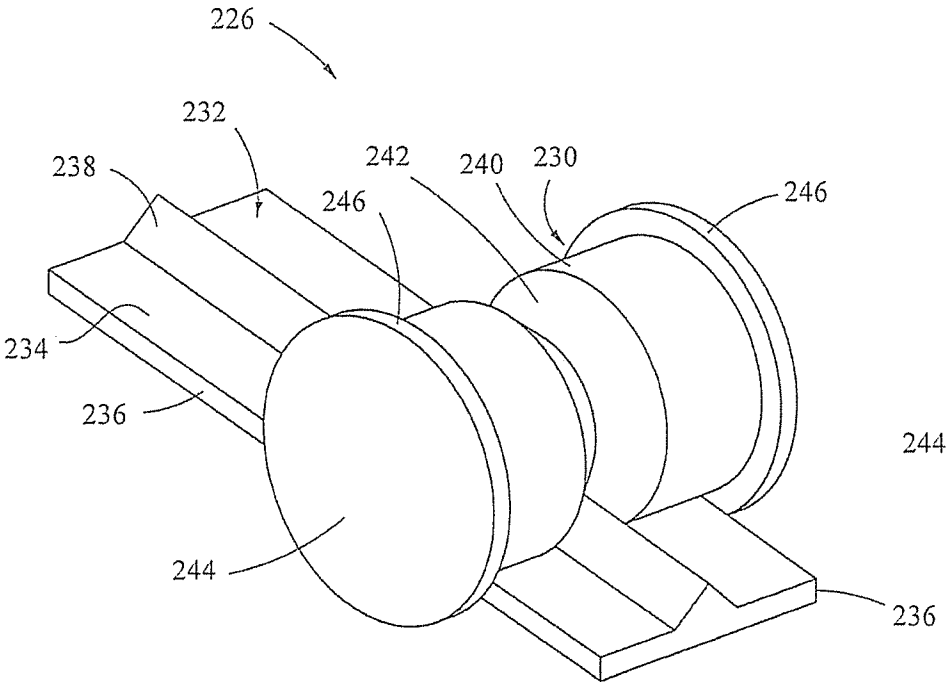
FIG. 19A is a perspective view of another embodiment of a bridge assembly.
Figure 12:
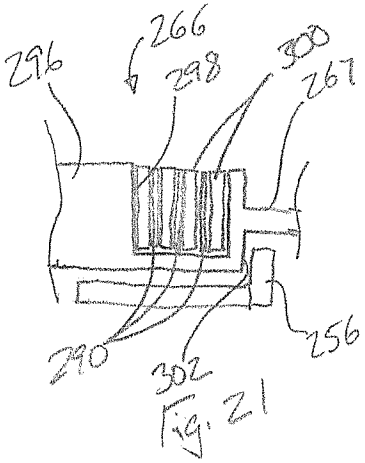

With reference next to FIGS. 19A and B, another embodiment of a bridge assembly 226 comprises a roller saddle 230 to roll over a race 232. The race 232 comprises an elongated base plate 234 having opposing side edges 236 and an elongated ridge 238 extending generally centrally along the race 232. In the illustrated embodiment, the elongated ridge 238 has a generally upside-down V shape. The roller saddle 230 comprises a cylindrical body 240 and a circumferential groove/saddle 242 that is configured to receive a string seated 30 therewithin. Preferably, the groove/saddle 242 has a shape complementary to the elongated ridge 238 so that the roller saddle 230 receives the ridge 238 therein and is precisely guided as it rolls along the race 232.

The illustrated roller saddle 230 also comprises side faces 244 and side ridges 174 adjacent the side faces 244. The illustrated side ridges 246 have a diameter greater than the adjacent cylindrical body 240 and preferably are placed so as to hang over the side edges 236 of the race 232, also to help align the roller saddle 230 as the cylindrical body 240 rolls over the race 232.

It is to be understood that, in additional embodiments, the roller saddle 230 may not include the side ridges 246, so that the cylindrical body 240 is guided only by the saddle 242 being engaged with the elongated ridge 238 or, alternatively, the race 232 may not include the ridge 238 so that the cylindrical body 240 is guided only by the side ridges 246 being aligned with the side edges 236 when rolling over the race 232.

Figure 20:
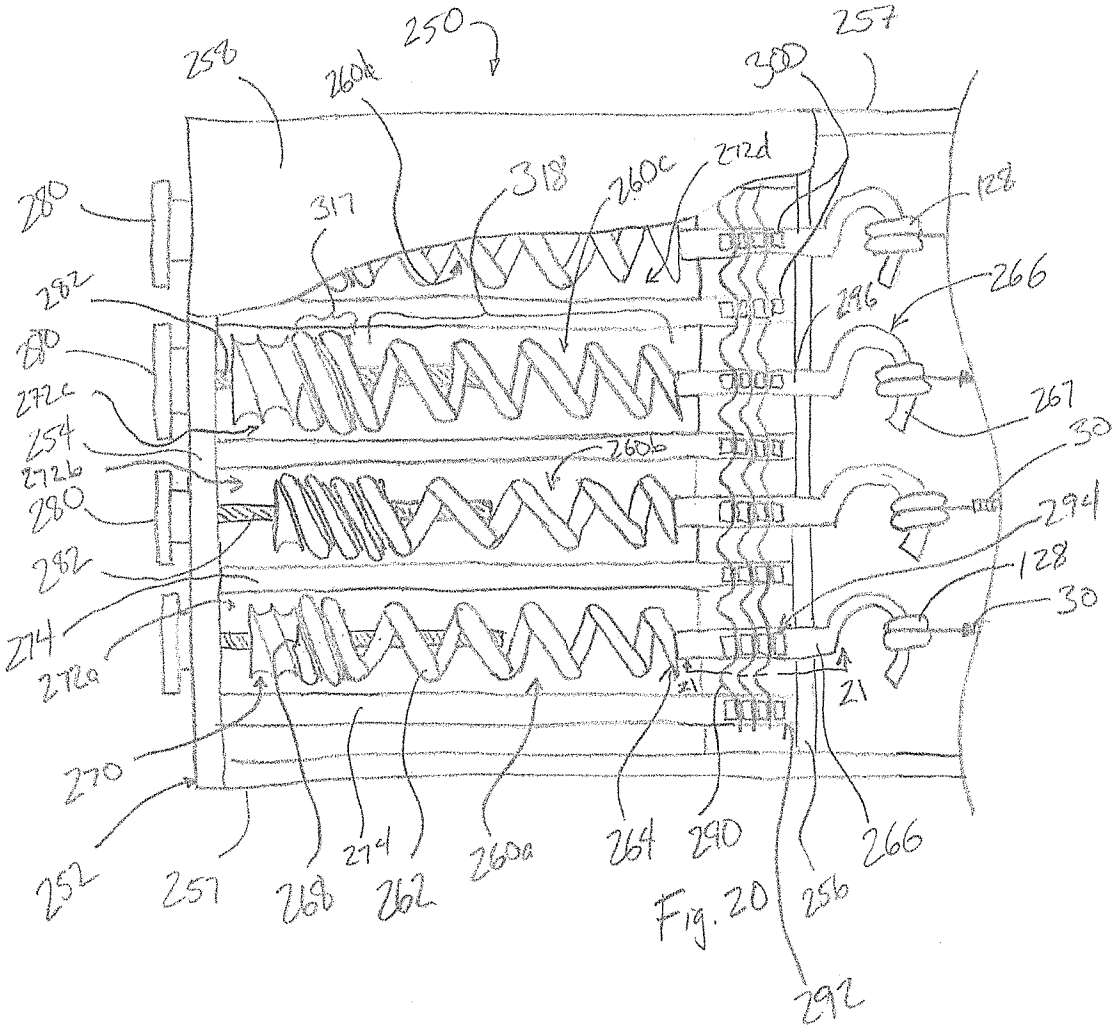
FIG. 20 is a top plan view of another embodiment of a string holder module.

With reference next to FIG. 20, another embodiment of a string holder module 250 comprises a string holder module frame 252 made up of a back wall 254, front wall 256, and sidewalls 257. Preferably the frame 252 can be enclosed by a cover plate 258. In FIG. 20, the cover plate 258 is depicted mostly cutaway in order to show internal structure of the string holder module 250. The string holder module 250 can be used with the bridge module 104 discussed above, and can also be used with other embodiments of bridge modules, including even very simple standard guitar bridges.

The string holder module 250 preferably comprises a plurality of string tensioners 260. In the illustrated embodiment, the module comprises four string tensioners 260*a-d*. Each string tensioner 260 comprises a primary spring 262 that is a coil spring having a distal end 264 that is attached to a string connector 266. A proximal end 268 of each primary spring 262 is connected to a spring holder 270. Each string connector 266 comprises a hook portion 267 that is configured to engage the string ball 128 of the corresponding musical string 30. Preferably, the distal end 264 of the primary spring 262 is rigidly connected to the connector 266 such as by welding or brazing. In other embodiments, the primary spring 262 could be connected to the connector 266 by other structures, such as a hook and pin.

Each of the string tensioners 260*a-d* preferably fits within a corresponding channel 272*a-d* defined between channel walls 274. A tuning knob 280 is aligned with the corresponding channel 272 but is arranged on the proximal side of the back wall 254. An elongated threaded tuning rod 282 is attached to each tuning knob 280 and extends from its tuning knob 280 through an aperture formed in the back wall 254 and into the channel 272. The tuning rod 282 also extends through a threaded aperture formed in a corresponding one of the spring holders 270. As such, rotation of the tuning knob 280 will cause longitudinal translation of the spring holder 270 over the rod 282, and thus will correspondingly increase or decrease the tension in the primary spring 262. As such, the tuning knob 280 enables a user to increase or decrease the tension applied to a corresponding musical string 30.

In the illustrated embodiment, each string tensioner 260 includes a plurality of secondary springs 290 which, in the illustrated embodiment, are leaves or sheets of spring steel. Stationary spring mounts 292 for each of the secondary springs 290 are formed on the channel walls 274, and connector spring mounts 294 are formed in each of the connectors 266. As such, the string connectors 266 function as carriers in a manner similar to as discussed above in the embodiments depicted in, for example, FIGS. 8-10. Thus, each string tensioner of the string holder module 250 can maintain a constant or near-constant tension in its corresponding musical string 30.

In the illustrated embodiment, each secondary spring 290 spans multiple string tensioners 260, and preferably spans entirely across, and is functionally part of, all of the string tensioners 260*a-d* of the string holder module 250. As such, the overall footprint of the string holder module, and the spacing between individual string tensioners, can be minimized. Also, manufacture of the structure can be simplified. It is to be understood, however, that in other embodiments each string tensioner 260 may have its own set of secondary springs or, in still further embodiments, sets of secondary springs can be shared by groups of one or more but less than all of the string tensioners in a string holder module. Additionally, although the illustrated embodiment employs three sheets or leave in the secondary spring 290, it is to be understood that additional embodiments may employ one, two, four, or more secondary spring leaves.

With continued reference to FIG. 20 and additional reference to FIG. 21, each of the spring mounts 292, 294, comprises a plurality of spacers 300 between which secondary springs 290 are sandwiched. The connector spring mount 294 is fondled in an elongate body portion 296 of the spring connector 266, and comprises a cavity 298 into which the spacers 300 and secondary springs 290 are placed. Some embodiments may additionally comprise a clamping structure as desired.

In the illustrated embodiment, as the relatively thick body portion 296 transitions to the relatively thin hook portion 267, the connector 266 forms an offset defining a stop surface 302. The front plate 256 of the frame 252 is positioned longitudinally aligned with the stop surface 302. Thus, as the string connector 266 is moved distally, the stop surface 302 will engage the front plate 256 to prevent distal translation of the string connector 266 beyond a desired operational range.

In some guitar-based embodiments a user may tension the string sufficient so that the stop surface 302 of the string connector 266 is immediately adjacent the front plate 256. As such, if the user desires to "bend" notes during play, and thus pulls or pushes a string 30, and correspondingly pulling the associated string connector 266 distally, the stop surface 302 will engage the front plate 256, preventing the string connector 266 from moving further distally to compensate for the user pulling on the string 30. This allows the user to increase the tension in the string, resulting in a "bent" note.

In some embodiments a slot can be formed in the front plate so that the string connector 266 fits therethrough. Preferably, the slot is sized so as to prevent transverse movement of the string connector 266. In still other embodiments, in addition to or instead of a slot, rollers or other low friction structure can be employed to restrict transverse motion of the string connector.

Figure 22:
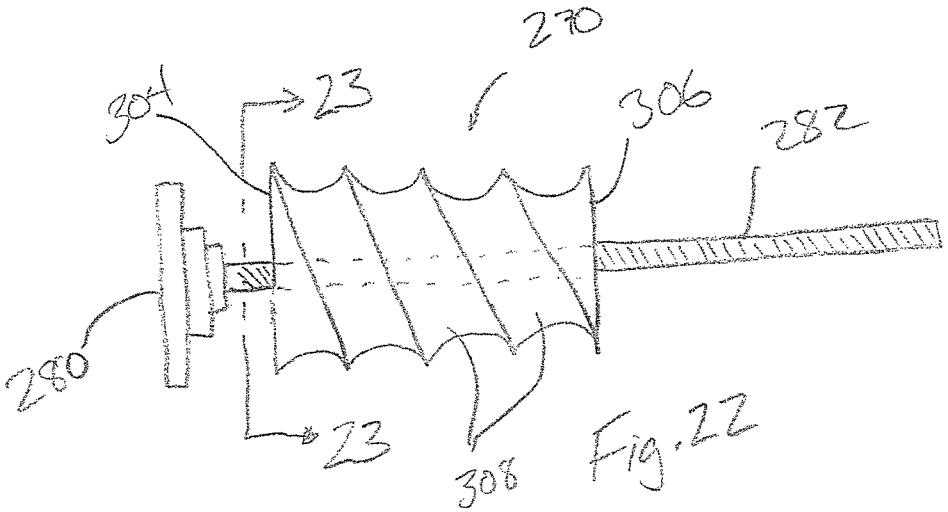
FIG. 22 is a side view of a spring holder for use in the string holder module of FIG. 20.
Figure 23:
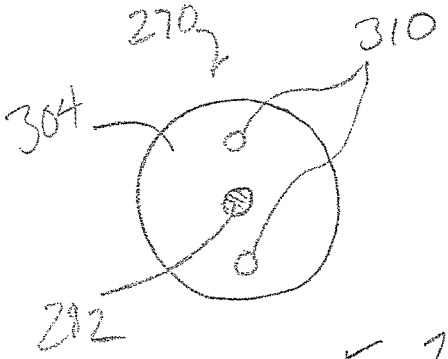
FIG. 23 is a top view of the spring holder taken along lines 23-23 of FIG. 22.

With reference next to FIGS. 22 and 23, the spring holder 270 preferably is elongated and extends between a back or proximal end 304 and a front or distal end 306. A plurality of threads 308 approximate the cross-sectional size and diameter of the coils of the primary spring 262. Spring coils at and adjacent the proximal end 268 of the spring 262 fit within the threads 308. Preferably the diameter of the spring holder threads 308 is selected to slightly expand the engaged spring coils so that the spring 262 is held tightly by the spring holder 270. As noted above, the threaded tuning rod 282 extends through a threaded aperture of the spring holder 270 so that as the rod 282 rotates, the spring holder 270 translates longitudinally over the rod 282, so long as the spring holder 270 does not rotate with the rod 282. Preferably, the spring 262 is mounted so as to resist rotating about its longitudinal axis, and the spring holder 270 holds the spring coils tightly enough so that the spring holder 270 does not rotate with the rod 282.

Figure 24:
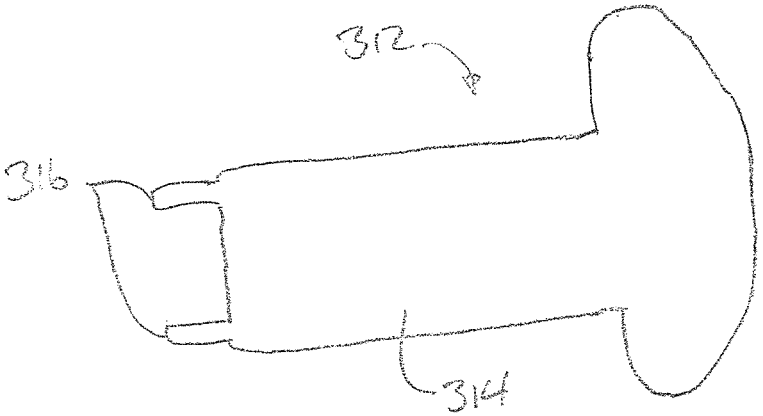
FIG. 24 is a side view of a calibration tool for use with the spring holder of FIG. 22.

A pair of receiver holes 310 are formed in the proximal end 304 of the spring holder 270. With additional reference to FIG. 24, a calibration tool 312 comprises an elongated body 314 that terminates at a pair of spaced apart posts 316 that are sized and spaced so as to fit into the receiver holes 310.

Figure 25:
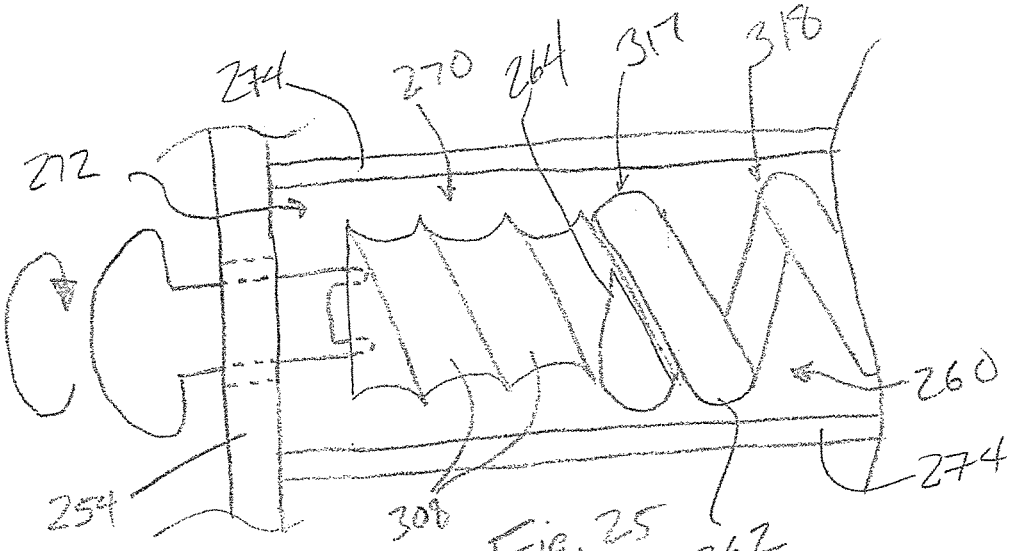
FIG. 25 is a top cutaway view of a portion of the string holder module of FIG. 22.
Figure 26:
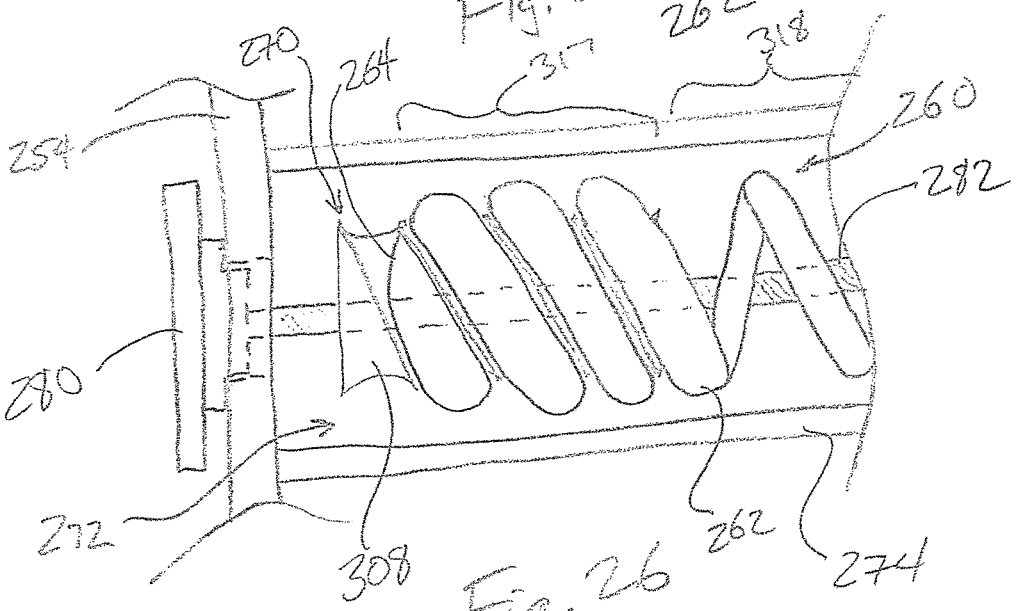
FIG. 26 shows the portion of FIG. 25 after performing certain operations.

Each spring holder 270 is configured both to hold the proximal end 268 of the primary spring 262 and to adjust the spring rate of that spring. With reference next to FIGS. 25 and 26, rotation of the spring holder 270, while the spring 262 is not rotated, enables a user to change the position of the spring holder 270 relative to the spring so as to engage more or less of the length and number of coils of the spring. With particular reference to FIG. 25, the spring 262 as shown has only parts of two coils engaged with the spring holder 270. Each of these engaged coils is held within a corresponding one of the threads 308 of the spring holder 270. As shown in FIG. 25, the tuning rod can be removed from the channel and the calibration tool 312 advanced into the channel 272 so that the posts 316 engage the receiver holes 310 of the spring holder 270. As the calibration tool 312 is rotated, progressively more of the primary spring 262 will become engaged in the threads 308 of the spring holder 270. For example, progressive rotation of the calibration tool 312 can lead to the configuration depicted in FIG. 26, in which portions of four of the coils of the primary spring 262 are engaged with threads 308 of the spring holder 270. When the desired level of engagement has been reached, the tuning rod 282 and knob 280 can be replaced as shown in FIG. 26.

The portion of the spring 262 that is held within the threads 308 of the spring holder 270 is constrained by the threads 308 from expanding and contracting. As such this portion is considered an inactive portion 317 of the spring, while the coils that are not so constrained are considered an active portion 318 of the spring 262. Adjustment, or calibration, of the spring holder 270 changes the active length, or active number of coils, of the spring 262, and thus adjusts the spring rate.

In some embodiments, it is desired for the primary springs 262 of all of the tensioner as 260*a-d* of a string holder module 250 to have substantially the same spring rate as the collective spring rate of the secondary spring 290. Due to several factors, including manufacturing variations, the primary springs 262 of the string holder module 250 may have differing spring rates, which spring rates differ from that of the secondary spring 290. As such, in accordance with some embodiments, the spring holders 270 are calibrated in order to adjust the spring rates of each primary spring 262 to the desired value. In some embodiments that desired spring rate value will be the same as the spring rate of the secondary springs 290. In other embodiments, the desired spring rate value may be the same as others of the primary springs 262. In still other embodiments, the spring rate of a particular primary spring 262 may be adjusted to match the desired spring rate for a particular size or configuration of musical string or, for example in other applications, an industrial wire. Adjustment of the spring holder 270 adjusts the number of active coils, or the active length, of the spring.

Figure 27:
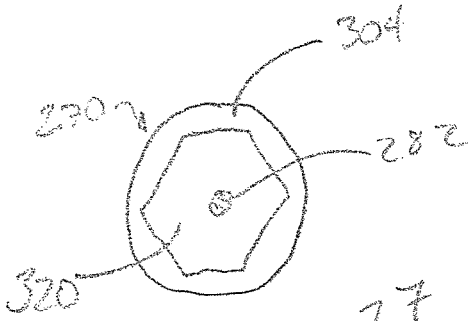
FIG. 27 is a top view of another embodiment of a spring holder

With reference next to FIG. 27, another embodiment of a spring holder 270 may include a raised hexagonal head 320 instead of or in addition to receiver holes 310. In some embodiments, a spring holder 270 employing such a raised hexagonal head 320 can be rotated using a tool such as a wrench that approaches the spring holder 270 from a position transverse to the spring holder axis, as opposed to the longitudinal approach taken by the calibration tool 312. As such, the spring holder 270 can be adjusted while the tuning knob 280 and tuning rod 282 remain in place. Of course, other adjustment structures and methods can be employed as desired.

Figure 28:
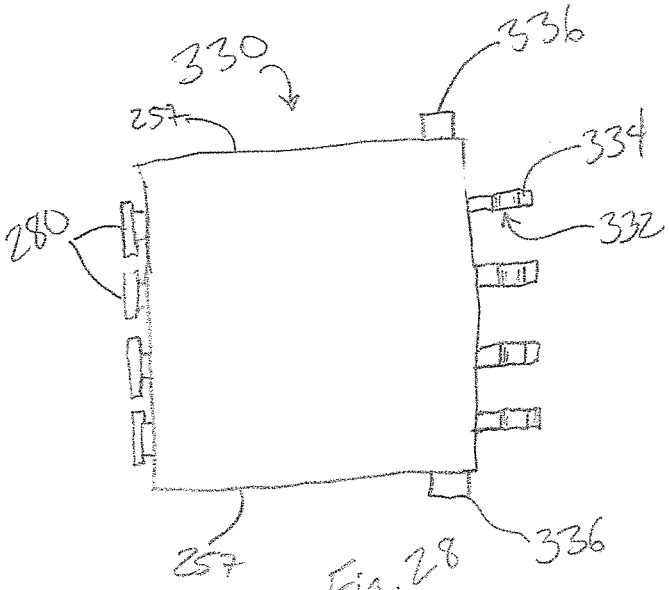
FIG. 28 is a top plan view of another embodiment of a string holder module.
Figure 29:
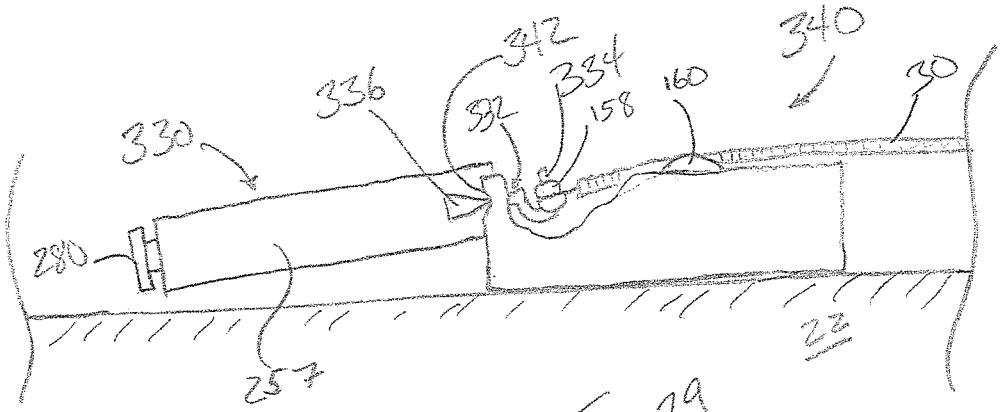
FIG. 29 is a side partially cutaway view of the string holder of FIG. 28 engaged with an embodiment of a bridge module in accordance with one embodiment.

With reference next to FIGS. 28 and 29, yet another embodiment of a string holder module 330 is depicted. The string holder module 30 can have structure basically similar to the embodiments described above. In the illustrated embodiment, the string connectors 332 employ hook portions 334 that extend in a direction rotationally spaced about 90° from the direction of the hook portions 267 in the embodiment described above. It is to be understood that either arrangement can be acceptable. In the illustrated embodiment, contact members 336 extend outwardly from the side walls 257 near the front or distal end of the module 330. The illustrated contact member 336 is substantially wedge-shaped, with the point of the wedge facing toward the distal or front end of the module 330.

With particular reference to FIG. 29, in the illustrated embodiment, a bridge module 340 is mounted to the body 92 of an instrument such as a guitar 90. The bridge module 340 can have any desired construction, including a construction similar to embodiments described herein. A proximal end of the bridge module comprises a V-shaped receiver 342 on either side of the module. As shown, the contact members 336 of the string holder module 330 engage the receivers 342 of the bridge module 340, and the hook portions 334 of the string connectors 332 engage string balls 128 of corresponding strings 30. When the arrangement is brought into appropriate tension, the tension of the strings and springs of the string holder module 330 cause the string holder module 330 to be held securely in place without being rigidly attached to the body of the guitar, and even without necessarily touching the body of the guitar.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A constant tension device, comprising:

a carrier configured to move along a longitudinal axis within an operational range defined between a first axis position and a second axis position; and a spring structure attached to the carrier so as to apply a spring force to the carrier, the spring structure comprising a first spring having a first end and a second end, the first end connected to the carrier, the second end connected to a first spring mount that is spaced from the carrier, the first spring applying a first spring force along a first spring force line that is directed across the axis and at a first spring angle relative to a line normal to the axis, the first spring force having a first axial force component that is applied to the carrier in a direction along the axis;

wherein when the carrier moves along the axis the first spring angle changes; and wherein within the operating range the carrier passes through a position at which, with an incremental change in the position of the carrier, a corresponding incremental change in the first axial force component transitions from increasing to decreasing.

2. A constant tension device as in claim 1, wherein the first spring angle is decreasing when the incremental change in the first axial force component changes from increasing to decreasing.

3. A constant tension device as in claim 2, wherein at a change angle the incremental change in the first axial force component changes from increasing to decreasing.

4. A constant tension device as in claim 3, wherein the spring is selected so that a cumulative axial force applied to the carrier corresponds to a preferred tension when the first spring is disposed at the change angle.

5. A constant tension device as in claim 4, wherein the change angle is about 37° and the spring is first put under load at 60°.

6. A constant tension device as in claim 4, wherein a wire or string is attached to the carrier and extends along the axis, and the cumulative axial force component is applied to the wire or string so that a tension in the wire or string is the same as the cumulative axial force.

7. A constant tension device as in claim 6, wherein the constant tension device comprises a string holder configured to attach to a musical instrument, the carrier comprises a string connector, and the wire or string comprises a musical string, and wherein the preferred tension corresponds to a preferred tuning tension of the musical string.

8. A constant tension device as in claim 3, wherein the operational range between the first axis position and the second axis position corresponds to up to 5° greater than and less than the change angle.

9. A constant tension device as in claim 6, wherein the spring structure comprises a second spring, the second spring arranged to mirror the first spring about the axis so as to apply a second axial force component to the carrier in a direction along the axis.

10. A constant tension device as in claim 9, wherein the first axial force component and the second axial force component are substantially equal.

11. A constant tension device as in claim 9, wherein a wire or string is attached to the carrier and extends along the axis, wherein the second axial force component is applied to the wire or string in addition to the first axial force component.

12. A method for tuning a stringed musical instrument, the musical instrument having a string connector configured to move along a longitudinal axis within an operating range defined between a first axis position and a second axis position, and a spring, the spring having a first end connected to the string connector and a second end connected to a spring mount that is spaced from the string connector, the spring applying a spring force along a spring force line that is directed across the axis and at a spring angle relative to a line normal to the axis, the spring force having an axial force component that is applied to the string connector in a direction along the axis, the method comprising:

attaching a musical string to the string connector so that the musical string extends along the axis, wherein the axial force component is applied to the musical string; and tightening the musical string so that the string connector is moved along the axis to a preferred position within the operating range, wherein when the string connector moves along the axis the spring angle changes.

13. A method as in claim 12, wherein when moving within the operating range the string connector moves to a change position at which, with an incremental change in the position of the string connector, the axial force component changes from incrementally increasing to incrementally decreasing.

14. A method as in claim 13, wherein the preferred position is the change position, and the spring angle is at a change angle at the preferred position.

15. A method as in claim 14 additionally comprising beginning to apply compression force to the spring when moving the string connector so that the spring angle moves below 60° , and wherein the change angle is about 37°.

16. A method as in claim 14, wherein a second spring has a first end connected to the string connector and a second end connected to a second spring mount that is spaced from the string connector, the second spring arranged to mirror the spring about the axis so as to apply a second axial force component to the string connector in a direction along the axis.

17. A method as in claim 12, wherein when moving within the operating range the string connector moves to a position at which the spring angle is 0°.

18. A method as in claim 17, wherein at the preferred position the spring angle is 0°.

19. A method as in claim 17, wherein the first axis position is no more than 5° greater than the preferred position, and the second axis position is no more than 5° less than the preferred position.

20. A method as in claim 17, wherein an axial spring rate component of the spring changes depending on the spring angle, and wherein a primary spring has a first end attached to the string connector and a second end attached to a primary spring mount, the primary spring being aligned with the axis, and wherein the primary spring has a primary spring rate selected to approximate the axial spring rate component at the preferred position.

* * * * *